US008950929B2

(12) United States Patent
Globerman et al.

(10) Patent No.: US 8,950,929 B2
(45) Date of Patent: Feb. 10, 2015

(54) FLUID DELIVERY SYSTEM

(75) Inventors: Oren Globerman, Kfar-Shemaryahu (IL); Mordechay Beyar, Caesarea (IL)

(73) Assignee: DePuy Synthes Products, LLC, Raynham, MA (US)

( * ) Notice: Subject to any disclaimer, the term of this patent is extended or adjusted under 35 U.S.C. 154(b) by 575 days.

(21) Appl. No.: 12/441,743

(22) PCT Filed: Oct. 18, 2007

(86) PCT No.: PCT/IL2007/001257

§ 371 (c)(1), (2), (4) Date: Jun. 8, 2009

(87) PCT Pub. No.: WO2008/047371

PCT Pub. Date: Apr. 24, 2008

(65) Prior Publication Data

US 2010/0065154 A1 Mar. 18, 2010

Related U.S. Application Data

(60) Provisional application No. 60/862,163, filed on Oct. 19, 2006.

(51) Int. Cl.

| | |
|---|---|
| ***B01F 13/00*** | (2006.01) |
| ***B01F 15/02*** | (2006.01) |
| ***B01F 7/30*** | (2006.01) |

(52) U.S. Cl.

CPC ..... *B01F 15/0205* (2013.01); *B01F 7/30* (2013.01); *B01F 15/0212* (2013.01); *B01F 15/0225* (2013.01); *B01F 2215/0029* (2013.01)

USPC ..... 366/130; 141/329; 141/330

(58) Field of Classification Search

USPC ..... 141/319, 329, 330; 366/130; 604/403–415

See application file for complete search history.

(56) References Cited

U.S. PATENT DOCUMENTS

| | | | |
|---|---|---|---|
| 229,932 | A | 7/1880 | Witsil |
| 370,335 | A | 9/1887 | Hunter |
| 817,973 | A | 4/1906 | Hausman |
| 833,044 | A | 10/1906 | Goodhugh |
| 843,587 | A | 2/1907 | DePew |
| 1,175,530 | A | 3/1916 | Kirchoff |

(Continued)

FOREIGN PATENT DOCUMENTS

| | | |
|---|---|---|
| AU | 724544 | 11/1996 |
| AU | 9865136 | 9/1998 |

(Continued)

OTHER PUBLICATIONS

Japanese Office Action issued Dec. 6, 2011 for Application No. 2008-524651 (9 Pages).

(Continued)

*Primary Examiner* — Timothy L Maust

(74) *Attorney, Agent, or Firm* — Nutter McClennen & Fish LLP

(57) ABSTRACT

A fluid delivery system for dispensing a liquid from a sealed container directly into a closed chamber comprises a container containing a liquid component of bone cement and plugged with a plug, and a closed chamber comprising a receiving port for receiving the sealed container, wherein the receiving port is configured to receive the liquid component in direct response to manual insertion of the sealed container through the receiving port using an open loop system.

33 Claims, 4 Drawing Sheets

(56) References Cited

U.S. PATENT DOCUMENTS 1,612,281 A 12/1926 Goetz
1,612,996 A 1/1927 Waagbo
1,733,516 A 10/1929 Jamison
1,894,274 A 1/1933 Jacques
1,929,247 A 10/1933 Hein
408,668 A 4/1934 Norman et al.
2,067,458 A 1/1937 Nichols
2,123,712 A 7/1938 Clark
2,283,915 A 5/1942 Cole
2,394,488 A 2/1946 Rotter et al.
2,425,867 A 8/1947 Davis
2,435,647 A 2/1948 Engseth
2,497,762 A 2/1950 Davis
2,521,569 A 9/1950 Davis
2,567,960 A 9/1951 Meyers et al.
2,745,575 A 5/1956 Spencer
2,773,500 A 12/1956 Young
2,808,239 A 10/1957 Alfred
2,874,877 A 2/1959 Spencer
2,918,841 A 12/1959 Poupitch
2,928,574 A 3/1960 Wagner
2,970,773 A 2/1961 Horace et al.
3,058,413 A 11/1962 Cavalieri
3,063,449 A 11/1962 Schultz
3,075,746 A 1/1963 Yablonski et al.
3,108,593 A 10/1963 Glassman
3,151,847 A 10/1964 Broomall
3,198,194 A * 8/1965 Wilburn ..... 206/221
3,216,616 A 11/1965 Blankenship, Jr.
3,224,744 A 12/1965 Broomall
3,225,760 A 12/1965 Di Cosola
3,254,494 A 6/1966 Chartouni
3,362,793 A 1/1968 Massoubre
3,381,566 A 5/1968 Passer
3,426,364 A 2/1969 Lumb
3,515,873 A 6/1970 Higgins
3,568,885 A 3/1971 Spencer
3,572,556 A 3/1971 Pogacar
3,615,240 A 10/1971 Sanz
3,674,011 A 7/1972 Michel et al.
3,701,350 A 10/1972 Guenther
3,750,667 A 8/1973 Pshenichny et al.
3,789,727 A 2/1974 Moran
3,796,303 A 3/1974 Allet-Coche
3,798,982 A 3/1974 Lundquist
3,846,846 A 11/1974 Fischer
3,850,158 A 11/1974 Elias et al.
3,867,728 A 2/1975 Stubsted et al.
3,873,008 A 3/1975 Jahn
3,875,595 A 4/1975 Froning
3,896,504 A 7/1975 Fischer
3,901,408 A 8/1975 Boden et al.
3,921,858 A 11/1975 Bemm
3,931,914 A 1/1976 Hosaka et al.
3,942,407 A 3/1976 Mortensen
3,976,060 A 8/1976 Hildebrandt et al.
3,993,250 A 11/1976 Shure
4,011,602 A 3/1977 Rybicki et al.
4,062,274 A 12/1977 Knab
4,077,494 A 3/1978 Spaude et al.
4,079,917 A 3/1978 Popeil
4,090,640 A 5/1978 Smith et al.
4,093,576 A 6/1978 Dewijn
4,105,145 A 8/1978 Capra
4,115,346 A 9/1978 Gross et al.
4,146,334 A 3/1979 Farrell
4,168,787 A 9/1979 Stamper
4,170,990 A 10/1979 Baumgart et al.
4,180,070 A * 12/1979 Genese ..... 604/88
4,185,072 A 1/1980 Puderbaugh et al.
4,189,065 A 2/1980 Herold
4,198,975 A 4/1980 Haller
4,204,531 A 5/1980 Aginsky
4,239,113 A 12/1980 Gross et al.
4,250,887 A 2/1981 Dardik et al.
4,257,540 A 3/1981 Wegmann et al.
4,268,639 A 5/1981 Seidel et al.
4,274,163 A 6/1981 Malcolm et al.
4,276,878 A 7/1981 Storz
4,277,184 A 7/1981 Solomon
4,298,144 A 11/1981 Pressi
4,309,777 A 1/1982 Patil
4,312,343 A 1/1982 LeVeen et al.
4,313,434 A 2/1982 Segal
4,326,567 A 4/1982 Mistarz
4,338,925 A 7/1982 Miller
4,341,691 A 7/1982 Anuta
4,346,708 A 8/1982 LeVeen et al.
4,349,921 A 9/1982 Kuntz
4,359,049 A 11/1982 Redl et al.
4,373,217 A 2/1983 Draenert
4,380,398 A 4/1983 Burgess
4,400,170 A 8/1983 McNaughton et al.
4,403,989 A 9/1983 Christensen et al.
4,404,327 A 9/1983 Crugnola et al.
4,405,249 A 9/1983 Scales
4,409,966 A 10/1983 Lambrecht et al.
4,453,539 A 6/1984 Raftopoulos et al.
4,474,572 A 10/1984 McNaughton et al.
4,475,856 A 10/1984 Toomingas
4,476,866 A 10/1984 Chin
4,487,602 A 12/1984 Christensen et al.
4,494,535 A 1/1985 Haig
4,500,658 A 2/1985 Fox
4,503,169 A 3/1985 Randklev
4,522,200 A 6/1985 Stednitz
D279,499 S 7/1985 Case
4,543,966 A 10/1985 Islam et al.
4,546,767 A 10/1985 Smith
4,554,914 A 11/1985 Kapp et al.
4,558,693 A 12/1985 Lash et al.
4,562,598 A 1/1986 Kranz
4,576,152 A 3/1986 Miller et al.
4,588,583 A 5/1986 Pietsch et al.
4,593,685 A 6/1986 McKay et al.
4,595,006 A 6/1986 Burke et al.
4,600,118 A 7/1986 Martin
4,605,011 A 8/1986 Naslund
4,632,101 A 12/1986 Freedland
4,636,217 A 1/1987 Ogilivie et al.
4,642,099 A 2/1987 Phillips et al.
4,650,469 A 3/1987 Berg et al.
4,651,904 A 3/1987 Schuckman
4,653,487 A 3/1987 Maale
4,653,489 A 3/1987 Tronzo et al.
4,664,298 A 5/1987 Shew
4,664,655 A 5/1987 Orentreich et al.
4,668,220 A 5/1987 Hawrylenko
4,668,295 A 5/1987 Abjpai
4,670,008 A 6/1987 Von Albertini
4,671,263 A 6/1987 Draenert
4,676,655 A 6/1987 Handler
4,676,781 A 6/1987 Phillips et al.
4,686,973 A 8/1987 Frisch
4,697,584 A 10/1987 Haynes
4,697,929 A 10/1987 Muller
4,704,035 A 11/1987 Kowalczyk
4,710,179 A 12/1987 Haber et al.
4,714,721 A 12/1987 Franek et al.
4,717,383 A 1/1988 Phillips et al.
4,718,910 A 1/1988 Draenert
4,722,948 A 2/1988 Sanderson
4,735,616 A 4/1988 Eibl et al.
4,737,151 A 4/1988 Clement et al.
4,747,832 A 5/1988 Buffet
4,758,096 A 7/1988 Gunnarsson
4,758,234 A 7/1988 Orentreich et al.
4,759,769 A 7/1988 Hedman et al.
4,762,515 A 8/1988 Grimm
4,767,033 A 8/1988 Gemperle
4,772,287 A 9/1988 Ray et al.
4,782,118 A 11/1988 Fontanille et al.
4,786,184 A 11/1988 Berezkina et al.
4,791,150 A 12/1988 Braden et al.

(56) References Cited

U.S. PATENT DOCUMENTS 4,792,577 A 12/1988 Chen et al.
4,804,023 A 2/1989 Frearson
4,813,870 A 3/1989 Pitzen
4,815,454 A 3/1989 Dozier
4,815,632 A 3/1989 Ball et al.
4,826,053 A 5/1989 Keller
4,830,227 A 5/1989 Ball et al.
4,837,279 A 6/1989 Arroyo
4,854,312 A 8/1989 Raftopoulos et al.
4,854,482 A 8/1989 Bergner
4,854,716 A 8/1989 Ziemann et al.
4,863,072 A 9/1989 Perler
4,869,906 A 9/1989 Dingeldein et al.
4,872,936 A 10/1989 Engelbrecht
4,892,231 A 1/1990 Ball
4,892,550 A 1/1990 Huebsch
4,902,649 A 2/1990 Kimura et al.
4,904,260 A 2/1990 Ray et al.
4,908,017 A 3/1990 Howson et al.
4,910,259 A 3/1990 Kindt-Larsen et al.
4,927,866 A 5/1990 Purrmann et al.
4,932,969 A 6/1990 Frey et al.
4,935,029 A 6/1990 Matsutani et al.
4,944,065 A 7/1990 Svanberg et al.
4,944,726 A 7/1990 Hilal et al.
4,946,077 A 8/1990 Olsen
4,946,285 A 8/1990 Vennemeyer
4,946,901 A 8/1990 Lechner et al.
4,961,647 A 10/1990 Coutts et al.
4,966,601 A 10/1990 Draenet
4,968,303 A 11/1990 Clarke et al.
4,969,888 A 11/1990 Schoulten et al.
4,973,168 A 11/1990 Chan
4,973,301 A 11/1990 Nissenkorn
4,973,334 A 11/1990 Ziemann
4,978,336 A 12/1990 Capozzi et al.
4,983,164 A 1/1991 Hook et al.
4,994,065 A 2/1991 Gibbs et al.
4,995,868 A 2/1991 Brazier
5,004,501 A 4/1991 Faccioloi et al.
5,006,112 A 4/1991 Metzner
5,012,066 A 4/1991 Matsutani et al.
5,015,233 A 5/1991 McGough et al.
5,018,919 A 5/1991 Stephan
5,022,563 A 6/1991 Marchito et al.
5,024,232 A 6/1991 Smid et al.
5,028,141 A 7/1991 Stiegelmann
5,037,473 A 8/1991 Antonucci et al.
5,049,157 A 9/1991 Mittelmeier et al.
5,051,482 A 9/1991 Tepic
5,059,193 A 10/1991 Kuslich
5,059,199 A 10/1991 Okada et al.
5,061,128 A 10/1991 Jahr et al.
5,071,040 A 12/1991 Laptewicz, Jr.
5,074,871 A 12/1991 Groshong
5,078,919 A 1/1992 Ashley et al.
5,092,888 A 3/1992 Iwamoto et al.
5,102,413 A 4/1992 Poddar
5,108,403 A 4/1992 Stern
5,108,404 A 4/1992 Scholten et al.
5,112,333 A 5/1992 Fixel
5,114,240 A 5/1992 Kindt-Larsen et al.
5,116,335 A 5/1992 Hannon
5,122,400 A 6/1992 Stewart
5,123,926 A 6/1992 Pisharodi
5,125,971 A 6/1992 Nonami et al.
5,131,382 A 7/1992 Meyer
5,141,496 A 8/1992 Dalto et al.
5,145,250 A 9/1992 Planck et al.
5,147,903 A 9/1992 Podszun et al.
5,171,248 A 12/1992 Ellis
5,171,278 A 12/1992 Pisharodi
5,181,918 A 1/1993 Brandhorst et al.
5,188,259 A 2/1993 Petit
5,190,191 A 3/1993 Reyman
5,192,327 A 3/1993 Brantigan
5,193,907 A 3/1993 Facciolli
5,209,753 A 5/1993 Biedermann et al.
5,217,147 A 6/1993 Kaufman
5,219,897 A 6/1993 Murray
5,236,445 A 8/1993 Hayhurst et al.
5,242,983 A 9/1993 Kennedy et al.
5,252,301 A 10/1993 Nilson et al.
5,254,092 A 10/1993 Polyak
5,258,420 A 11/1993 Posey-Dowty et al.
5,264,215 A 11/1993 Nakabayashi et al.
5,268,001 A 12/1993 Nicholson et al.
5,269,762 A 12/1993 Armbruster et al.
5,275,214 A 1/1994 Rehberger
5,276,070 A 1/1994 Arroyo
5,277,339 A 1/1994 Shew et al.
5,279,555 A 1/1994 Lifshey
5,290,260 A 3/1994 Stines
5,295,980 A 3/1994 Ersek
5,302,020 A 4/1994 Kruse
5,303,718 A 4/1994 Kajicek
5,304,147 A 4/1994 Johnson et al.
5,318,532 A 6/1994 Frassica
5,328,262 A 7/1994 Lidgren et al.
5,328,362 A 7/1994 Watson et al.
5,331,972 A 7/1994 Wadhwani et al.
5,333,951 A 8/1994 Wakoh
5,334,184 A 8/1994 Bimman
5,334,626 A 8/1994 Lin
5,336,699 A 8/1994 Cooke et al.
5,336,700 A 8/1994 Murray
5,344,232 A 9/1994 Nelson et al.
5,348,391 A 9/1994 Murray
5,348,548 A * 9/1994 Meyer et al. ..... 604/403
5,350,372 A * 9/1994 Ikeda et al. ..... 604/414
5,354,287 A 10/1994 Wacks
5,356,382 A 10/1994 Picha et al.
5,368,046 A 11/1994 Scarfone et al.
5,368,386 A 11/1994 Murray
5,370,221 A 12/1994 Magnusson et al.
5,372,583 A 12/1994 Roberts et al.
5,374,427 A 12/1994 Stille et al.
5,375,583 A 12/1994 Meyer et al.
5,376,123 A 12/1994 Klaue et al.
5,380,772 A 1/1995 Hasegawa et al.
5,385,081 A 1/1995 Sneddon
5,385,566 A 1/1995 Ullmaerk
5,387,191 A 2/1995 Hemstreet et al.
5,390,683 A 2/1995 Pisharodi
5,395,167 A 3/1995 Murray
5,395,326 A 3/1995 Haber et al.
5,398,483 A 3/1995 Smith et al.
5,401,806 A 3/1995 Braden et al.
5,411,180 A 5/1995 Dumelle
5,415,474 A 5/1995 Nelson et al.
5,423,850 A 6/1995 Berger
5,431,654 A 7/1995 Nic
5,435,645 A 7/1995 Faccioli
5,443,182 A 8/1995 Tanaka et al.
5,445,639 A 8/1995 Kuslich et al.
5,450,924 A 9/1995 Tseng
5,454,365 A 10/1995 Bonutti
5,456,267 A 10/1995 Stark
5,468,245 A 11/1995 Vargas, III
5,480,400 A 1/1996 Berger
5,480,403 A 1/1996 Lee
5,482,187 A 1/1996 Poulsen et al.
5,492,247 A 2/1996 Shu et al.
5,494,349 A 2/1996 Seddon
5,501,374 A 3/1996 Laufer et al.
5,501,520 A 3/1996 Lidgren et al.
5,501,695 A 3/1996 Anspach, Jr. et al.
5,512,610 A 4/1996 Lin
5,514,135 A 5/1996 Earle
5,514,137 A 5/1996 Coutts
5,518,498 A 5/1996 Lindenberg et al.
5,520,690 A 5/1996 Errico et al.
5,522,816 A 6/1996 Dinello et al.
5,522,899 A 6/1996 Michelson

(56) References Cited

U.S. PATENT DOCUMENTS 5,526,853 A * 6/1996 McPhee et al. ..... 141/329
5,531,519 A 7/1996 Earle
5,534,028 A 7/1996 Bao et al.
5,536,262 A * 7/1996 Velasquez ..... 604/533
5,545,460 A 8/1996 Tanaka et al.
5,548,001 A 8/1996 Podszun et al.
5,549,380 A 8/1996 Lidgren et al.
5,549,381 A 8/1996 Hays et al.
5,549,679 A 8/1996 Kuslich
5,551,778 A 9/1996 Hauke et al.
5,554,101 A 9/1996 Matula et al.
5,556,201 A 9/1996 Veltrop et al.
5,558,136 A 9/1996 Orrico
5,558,639 A 9/1996 Gangemi et al.
5,571,189 A 11/1996 Kuslich et al.
5,573,265 A 11/1996 Pradel
5,578,035 A 11/1996 Lin
5,586,821 A 12/1996 Bonitati et al.
5,588,745 A 12/1996 Tanaka et al.
5,591,197 A 1/1997 Orth et al.
5,601,557 A 2/1997 Hayhurst
5,603,701 A 2/1997 Fisher
5,609,637 A 3/1997 Biedermann et al.
5,624,184 A 4/1997 Chan
5,630,806 A 5/1997 Inagaki et al.
5,634,880 A 6/1997 Feldman et al.
5,637,097 A 6/1997 Yoon
5,638,997 A 6/1997 Hawkins et al.
5,641,010 A * 6/1997 Maier ..... 141/329
5,645,598 A 7/1997 Brosnahan, III
5,647,856 A 7/1997 Eykmann
5,653,686 A * 8/1997 Coulter et al. ..... 222/1
5,658,310 A 8/1997 Berger
5,660,186 A 8/1997 Bachir
5,665,067 A 9/1997 Linder et al.
5,681,317 A 10/1997 Caldarise
5,683,451 A 11/1997 Lenker et al.
5,685,826 A 11/1997 Bonutti
5,690,606 A 11/1997 Slotman
5,693,100 A 12/1997 Pisharodi
5,697,977 A 12/1997 Pisharodi
5,698,611 A 12/1997 Okada et al.
5,702,448 A 12/1997 Buechel et al.
5,704,895 A 1/1998 Scott et al.
5,707,390 A 1/1998 Bonutti
5,718,707 A 2/1998 Mikhail
5,720,753 A 2/1998 Sander et al.
5,725,341 A 3/1998 Hofmeister
5,725,529 A 3/1998 Nicholson et al.
5,747,553 A 5/1998 Guzauskas
5,752,935 A 5/1998 Robinson et al.
5,752,969 A 5/1998 Cunci et al.
5,752,974 A 5/1998 Rhee
5,755,732 A 5/1998 Green et al.
5,759,186 A 6/1998 Bachmann et al.
5,763,092 A 6/1998 Lee et al.
5,779,356 A 7/1998 Chan
5,782,713 A 7/1998 Yang
5,782,747 A 7/1998 Zimmon
5,782,830 A 7/1998 Farris
5,782,838 A 7/1998 Beyar et al.
5,785,647 A 7/1998 Tompkins et al.
5,792,044 A 8/1998 Foley
5,795,922 A 8/1998 Demian et al.
5,797,678 A 8/1998 Murray
5,800,169 A 9/1998 Muhlbauer
5,800,409 A 9/1998 Bruce
5,800,549 A 9/1998 Bao et al.
5,800,550 A 9/1998 Sertich
5,820,321 A 10/1998 Gruber
5,824,087 A 10/1998 Aspden et al.
5,826,713 A 10/1998 Sunago et al.
5,826,753 A 10/1998 Fehlig et al.
5,827,289 A 10/1998 Reiley et al.
5,829,875 A 11/1998 Hagel et al.
5,830,194 A 11/1998 Anwar et al.
5,836,306 A 11/1998 Duane et al.
5,839,621 A 11/1998 Tada
5,842,785 A 12/1998 Brown et al.
5,865,802 A 2/1999 Yoon et al.
5,876,116 A 3/1999 Barker et al.
5,876,457 A 3/1999 Picha et al.
5,882,340 A 3/1999 Yoon et al.
5,884,818 A 3/1999 Campbell
5,893,488 A 4/1999 Hoag et al.
5,893,850 A 4/1999 Cachia
5,902,839 A 5/1999 Lautenschlager et al.
5,911,721 A 6/1999 Nicholson et al.
5,918,702 A 7/1999 Cheng et al.
5,918,770 A 7/1999 Camm et al.
5,925,051 A 7/1999 Mikhail
5,928,239 A 7/1999 Mirza
5,931,347 A 8/1999 Haubrich
5,941,851 A 8/1999 Coffey et al.
5,954,671 A 9/1999 O'Neill
5,954,728 A 9/1999 Heller et al.
5,961,211 A 10/1999 Barker et al.
5,968,008 A 10/1999 Grams
5,968,044 A 10/1999 Nicholson et al.
5,968,999 A 10/1999 Ramp et al.
5,972,015 A 10/1999 Scribner et al.
5,980,527 A 11/1999 Cohen et al.
5,993,535 A 11/1999 Sawamura et al.
5,997,544 A 12/1999 Nies et al.
6,004,325 A 12/1999 Vargas, III
6,007,496 A 12/1999 Brannon
6,017,349 A 1/2000 Heller et al.
6,019,765 A 2/2000 Thornhill et al.
6,019,776 A 2/2000 Preissman et al.
6,019,789 A 2/2000 Dinh et al.
6,020,396 A 2/2000 Jacobs
6,033,105 A 3/2000 Barker et al.
6,033,411 A 3/2000 Preissman
6,039,761 A 3/2000 Li et al.
6,040,408 A 3/2000 Koole
6,041,977 A 3/2000 Lisi
6,042,262 A 3/2000 Hajianpour
6,045,555 A 4/2000 Smith et al.
6,048,346 A 4/2000 Reiley
6,049,026 A 4/2000 Muschler
6,075,067 A 6/2000 Lidgren
6,080,579 A 6/2000 Hanley, Jr.
6,080,801 A 6/2000 Draenert et al.
6,080,811 A 6/2000 Schehlmann et al.
6,083,229 A 7/2000 Constantz et al.
6,086,594 A 7/2000 Brown
6,103,779 A 8/2000 Guzauskas
6,116,773 A 9/2000 Murray
6,120,174 A 9/2000 Hoag et al.
6,124,373 A 9/2000 Peter et al.
6,126,689 A 10/2000 Brett
6,127,597 A 10/2000 Beyar et al.
6,129,763 A 10/2000 Chauvin et al.
6,132,396 A 10/2000 Antanavich et al.
6,136,038 A 10/2000 Raab
6,139,509 A 10/2000 Yuan et al.
6,142,998 A 11/2000 Smith et al.
6,146,401 A 11/2000 Yoon et al.
6,149,651 A 11/2000 Drewry et al.
6,149,655 A 11/2000 Constantz et al.
6,149,664 A 11/2000 Kurz
6,160,033 A 12/2000 Nies
6,161,955 A 12/2000 Rademaker
6,168,597 B1 1/2001 Biedermann et al.
6,174,935 B1 1/2001 Matsunae et al.
6,176,607 B1 1/2001 Hajianpour
6,183,441 B1 2/2001 Kriesel et al.
6,183,516 B1 2/2001 Burkinshaw et al.
6,187,015 B1 2/2001 Brenneman
6,190,381 B1 2/2001 Olsen et al.
6,210,031 B1 4/2001 Murray
6,214,012 B1 4/2001 Karpman et al.
6,214,016 B1 4/2001 Williams et al.
6,214,037 B1 4/2001 Mitchell et al.

(56) References Cited

U.S. PATENT DOCUMENTS 6,217,566 B1 4/2001 Ju et al.
6,217,581 B1 4/2001 Tolson
6,217,608 B1 4/2001 Penn et al.
6,221,029 B1 4/2001 Mathis et al.
6,224,604 B1 5/2001 Suddaby
6,228,049 B1 5/2001 Schroeder et al.
6,228,068 B1 5/2001 Yoon
6,228,082 B1 5/2001 Baker et al.
6,231,615 B1 5/2001 Preissman
6,235,043 B1 5/2001 Reiley et al.
6,238,399 B1 5/2001 Heller et al.
6,241,734 B1 6/2001 Scribner et al.
6,245,101 B1 6/2001 Drasler et al.
6,248,110 B1 6/2001 Reiley et al.
6,254,268 B1 7/2001 Long
6,261,289 B1 7/2001 Levy
6,264,618 B1 7/2001 Landi et al.
6,264,659 B1 7/2001 Ross et al.
6,264,660 B1 7/2001 Schmidt et al.
6,273,916 B1 8/2001 Murphy
6,281,271 B1 8/2001 Rumphorst et al.
6,309,395 B1 10/2001 Smith et al.
6,309,420 B1 10/2001 Preissman
6,312,149 B1 11/2001 Sojovall et al.
6,325,812 B1 12/2001 Dubrul et al.
6,348,055 B1 2/2002 Preissman
6,348,518 B1 2/2002 Montgomery
6,350,271 B1 2/2002 Kurz et al.
6,361,539 B1 3/2002 Heller et al.
6,364,865 B1 * 4/2002 Lavi et al. ..... 604/411
6,367,962 B1 4/2002 Mizutani et al.
6,375,659 B1 4/2002 Erbe et al.
6,375,682 B1 4/2002 Fleischmann et al.
6,383,188 B2 5/2002 Kuslich et al.
6,383,190 B1 5/2002 Preissman
6,395,007 B1 5/2002 Bhatnagar
6,402,701 B1 6/2002 Kaplan et al.
6,402,758 B1 6/2002 Tolson
6,406,175 B1 6/2002 Marino
6,409,972 B1 6/2002 Chan
6,410,612 B1 6/2002 Hatanaka
6,425,887 B1 7/2002 McGuckin et al.
6,431,743 B1 8/2002 Mizutani et al.
6,433,037 B1 8/2002 Guzauskas
6,436,143 B1 8/2002 Ross et al.
6,439,439 B1 8/2002 Rickard
6,443,334 B1 9/2002 John et al.
6,447,478 B1 9/2002 Maynards
6,450,973 B1 9/2002 Murphy
6,458,117 B1 10/2002 Pollins, Sr.
6,479,565 B1 11/2002 Stanley
6,488,667 B1 12/2002 Murphy
6,494,868 B2 12/2002 Amar
6,500,182 B2 12/2002 Foster
6,502,608 B1 1/2003 Burchett et al.
6,527,144 B2 3/2003 Ritsche et al.
6,550,957 B2 4/2003 Mizutani et al.
6,554,833 B2 4/2003 Levy et al.
6,572,256 B2 * 6/2003 Seaton et al. ..... 366/139
6,575,331 B1 6/2003 Peeler et al.
6,575,919 B1 6/2003 Reiley et al.
6,582,439 B1 6/2003 Sproul
6,592,559 B1 7/2003 Pakter et al.
6,595,967 B2 7/2003 Kramer
6,599,293 B2 7/2003 Tague et al.
6,599,520 B2 7/2003 Scarborough et al.
6,613,018 B2 9/2003 Bagga
6,613,054 B2 9/2003 Scribner et al.
6,626,912 B2 9/2003 Speitling
6,641,587 B2 11/2003 Scribner et al.
6,645,213 B2 11/2003 Sand et al.
6,662,969 B2 12/2003 Peeler et al.
6,676,664 B1 1/2004 Al-Assir
6,689,823 B1 2/2004 Bellare et al.
6,702,455 B2 3/2004 Vendrely et al.
6,712,853 B2 3/2004 Kuslich
6,716,216 B1 4/2004 Boucher et al.
6,719,761 B1 4/2004 Reiley et al.
6,720,417 B1 * 4/2004 Walter ..... 536/25.4
6,730,095 B2 5/2004 Olson, Jr. et al.
6,752,180 B2 * 6/2004 Delay ..... 141/97
6,758,837 B2 7/2004 Peciat et al.
6,759,449 B2 7/2004 Kimura et al.
6,767,973 B2 7/2004 Suau et al.
6,770,079 B2 8/2004 Bhatnagar
6,779,566 B2 * 8/2004 Engel ..... 141/25
6,780,175 B1 8/2004 Sachdeva et al.
6,783,515 B1 8/2004 Miller et al.
6,787,584 B2 9/2004 Jia et al.
6,796,987 B2 9/2004 Tague et al.
6,852,439 B2 2/2005 Frank
6,874,927 B2 4/2005 Foster
6,875,219 B2 4/2005 Arramon et al.
6,887,246 B2 5/2005 Bhatnagar
6,916,308 B2 7/2005 Dixon et al.
6,957,747 B2 10/2005 Peeler et al.
6,974,247 B2 12/2005 Frei et al.
6,974,416 B2 12/2005 Booker et al.
6,979,341 B2 12/2005 Scribner et al.
6,979,352 B2 12/2005 Reynolds
6,994,465 B2 2/2006 Tague et al.
6,997,930 B1 2/2006 Jaggi
7,008,433 B2 3/2006 Voellmicke et al.
7,025,771 B2 4/2006 Kuslich et al.
7,029,163 B2 * 4/2006 Barker et al. ..... 366/139
7,044,954 B2 5/2006 Reiley
7,048,743 B2 5/2006 Miller
7,066,942 B2 6/2006 Treace
7,087,040 B2 8/2006 McGuckin
7,091,258 B2 8/2006 Neubert et al.
7,097,648 B1 8/2006 Globerman et al.
7,112,205 B2 9/2006 Carrison
7,116,121 B1 10/2006 Holcombe et al.
7,252,671 B2 8/2007 Scribner
7,264,622 B2 9/2007 Michelson
7,270,667 B2 9/2007 Faccioli
7,278,778 B2 10/2007 Sand
7,326,203 B2 2/2008 Papineau et al.
7,456,024 B2 * 11/2008 Dahm et al. ..... 436/164
7,559,932 B2 7/2009 Truckai et al.
7,572,263 B2 8/2009 Preissman
7,575,577 B2 8/2009 Boyd et al.
7,604,618 B2 10/2009 Dixon et al.
7,666,205 B2 2/2010 Weikel et al.
7,678,116 B2 3/2010 Truckai et al.
7,717,918 B2 5/2010 Truckai et al.
7,722,620 B2 5/2010 Truckai et al.
8,066,713 B2 11/2011 DiMauro et al.
8,070,753 B2 12/2011 Truckai et al.
8,333,773 B2 12/2012 DiMauro et al.
8,360,629 B2 1/2013 Globerman et al.
8,361,078 B2 1/2013 Beyar et al.
8,415,407 B2 4/2013 Beyar et al.
8,540,722 B2 9/2013 Beyar et al.
8,809,418 B2 8/2014 Beyar et al.
2001/0012968 A1 8/2001 Preissman
2001/0034527 A1 10/2001 Scribner et al.
2002/0008122 A1 1/2002 Ritsche et al.
2002/0010471 A1 1/2002 Wironen
2002/0010472 A1 1/2002 Kuslich et al.
2002/0013553 A1 1/2002 Pajunk
2002/0049448 A1 4/2002 Sand et al.
2002/0049449 A1 4/2002 Bhatnagar et al.
2002/0058947 A1 5/2002 Hochschuler et al.
2002/0067658 A1 6/2002 Vendrely et al.
2002/0068939 A1 6/2002 Levy et al.
2002/0068974 A1 6/2002 Kuslich et al.
2002/0068975 A1 6/2002 Teitelbaum et al.
2002/0072768 A1 6/2002 Ginn
2002/0099384 A1 7/2002 Scribner et al.
2002/0099385 A1 7/2002 Ralph et al.
2002/0118595 A1 8/2002 Miller
2002/0156483 A1 10/2002 Voellmicke et al.
2002/0161373 A1 10/2002 Osorio et al.

(56) References Cited

U.S. PATENT DOCUMENTS

2002/0177866 A1 11/2002 Weikel et al.
2002/0188300 A1 12/2002 Arramon
2002/0191487 A1 12/2002 Sand
2003/0009177 A1 1/2003 Middleman et al.
2003/0018339 A1 1/2003 Higueras et al.
2003/0031698 A1 2/2003 Roeder et al.
2003/0032929 A1 2/2003 McGuckin et al.
2003/0036763 A1 2/2003 Bhatnagar et al.
2003/0040718 A1 2/2003 Keahey et al.
2003/0050644 A1 3/2003 Boucher et al.
2003/0050702 A1 3/2003 Berger
2003/0078589 A1 4/2003 Preissman
2003/0109883 A1 6/2003 Matsuzaki et al.
2003/0109884 A1 6/2003 Tague et al.
2003/0144742 A1 7/2003 King et al.
2003/0162864 A1 8/2003 Pearson et al.
2003/0174576 A1 9/2003 Tague et al.
2003/0181963 A1 9/2003 Pellegrino et al.
2003/0185093 A1 10/2003 Vendrely et al.
2003/0220414 A1 11/2003 Axen et al.
2003/0225364 A1 12/2003 Kraft et al.
2003/0231545 A1 12/2003 Seaton et al.
2004/0010263 A1 1/2004 Boucher et al.
2004/0029996 A1 2/2004 Kuhn
2004/0054377 A1 3/2004 Foster et al.
2004/0059283 A1 3/2004 Kirwan et al.
2004/0068264 A1 4/2004 Treace
2004/0073139 A1 4/2004 Hirsch et al.
2004/0092946 A1 5/2004 Bagga et al.
2004/0098015 A1 5/2004 Weikel et al.
2004/0106913 A1 6/2004 Eidenschink et al.
2004/0122438 A1 6/2004 Abrams
2004/0132859 A1 7/2004 Puckett, Jr. et al.
2004/0133124 A1 7/2004 Bates et al.
2004/0133211 A1 7/2004 Raskin et al.
2004/0138759 A1 7/2004 Muller et al.
2004/0157952 A1 8/2004 Soffiati et al.
2004/0157954 A1 8/2004 Imai et al.
2004/0167532 A1 8/2004 Olson et al.
2004/0167562 A1 8/2004 Osorio et al.
2004/0167625 A1 8/2004 Beyar et al.
2004/0193171 A1 9/2004 DiMauro
2004/0215202 A1 10/2004 Preissman
2004/0220672 A1 11/2004 Shadduck
2004/0226479 A1 11/2004 Lyles et al.
2004/0229972 A1 11/2004 Klee et al.
2004/0230309 A1 11/2004 DiMauro et al.
2004/0236313 A1 11/2004 Klein
2004/0249015 A1 12/2004 Jia et al.
2004/0249347 A1 12/2004 Miller et al.
2004/0260303 A1 12/2004 Carrison
2004/0260304 A1 12/2004 Faccioli et al.
2004/0267154 A1 12/2004 Sutton et al.
2005/0014273 A1* 1/2005 Dahm et al. ..... 436/45
2005/0015148 A1 1/2005 Jansen et al.
2005/0025622 A1 2/2005 Djeridane et al.
2005/0058717 A1 3/2005 Yetlinler
2005/0060023 A1 3/2005 Mitchell et al.
2005/0070912 A1 3/2005 Voellmicke
2005/0070914 A1 3/2005 Constantz et al.
2005/0070915 A1 3/2005 Mazzuca
2005/0083782 A1 4/2005 Gronau et al.
2005/0113762 A1 5/2005 Kay et al.
2005/0143827 A1 6/2005 Globerman et al.
2005/0154081 A1 7/2005 Yin et al.
2005/0180806 A1 8/2005 Green
2005/0203206 A1 9/2005 Trieu
2005/0209695 A1 9/2005 de Vries et al.
2005/0216025 A1 9/2005 Chern Lin et al.
2005/0256220 A1 11/2005 Lavergne et al.
2005/0281132 A1 12/2005 Armstrong et al.
2006/0035997 A1 2/2006 Orlowski et al.
2006/0041033 A1 2/2006 Bisig et al.
2006/0052794 A1 3/2006 McGill
2006/0074433 A1 4/2006 McGill et al.
2006/0079905 A1 4/2006 Beyar et al.
2006/0116643 A1 6/2006 Dixon et al.
2006/0116689 A1 6/2006 Albans et al.
2006/0116690 A1 6/2006 Pagano
2006/0122614 A1 6/2006 Truckai et al.
2006/0148923 A1 7/2006 Ashman et al.
2006/0167148 A1 7/2006 Engquist et al.
2006/0235338 A1 10/2006 Pacheco
2006/0241644 A1 10/2006 Osorio et al.
2006/0264695 A1 11/2006 Viole et al.
2006/0264967 A1 11/2006 Ferreyro et al.
2006/0266372 A1 11/2006 Miller et al.
2006/0271061 A1 11/2006 Beyar et al.
2006/0276819 A1 12/2006 Osorio et al.
2007/0027230 A1 2/2007 Beyar et al.
2007/0032567 A1 2/2007 Beyar et al.
2007/0055266 A1 3/2007 Osorio et al.
2007/0055267 A1 3/2007 Osorio et al.
2007/0055278 A1 3/2007 Osorio et al.
2007/0055280 A1 3/2007 Osorio et al.
2007/0055284 A1 3/2007 Osorio et al.
2007/0055285 A1 3/2007 Osorio
2007/0055300 A1 3/2007 Osorio et al.
2007/0060941 A1 3/2007 Reiley et al.
2007/0118142 A1 5/2007 Krueger
2007/0142842 A1 6/2007 Krueger
2007/0197935 A1 8/2007 Reiley et al.
2007/0198013 A1 8/2007 Foley et al.
2007/0198023 A1 8/2007 Sand et al.
2007/0198024 A1 8/2007 Plishka
2007/0255282 A1 11/2007 Simonton et al.
2007/0282443 A1 12/2007 Globerman et al.
2008/0039856 A1 2/2008 DiMauro
2008/0044374 A1 2/2008 Lavergne et al.
2008/0058827 A1 3/2008 Osorio et al.
2008/0065087 A1 3/2008 Osorio et al.
2008/0065089 A1 3/2008 Osorio et al.
2008/0065137 A1 3/2008 Boucher et al.
2008/0065142 A1 3/2008 Reiley et al.
2008/0065190 A1 3/2008 Osorio et al.
2008/0071283 A1 3/2008 Osorio et al.
2008/0086133 A1 4/2008 Kuslich et al.
2008/0132935 A1 6/2008 Osorio et al.
2008/0140079 A1 6/2008 Osorio et al.
2008/0140084 A1 6/2008 Osorio et al.
2008/0200915 A1 8/2008 Globerman et al.
2008/0212405 A1 9/2008 Globerman et al.
2008/0228192 A1 9/2008 Beyar et al.
2009/0264892 A1 10/2009 Beyar et al.
2009/0264942 A1 10/2009 Beyar et al.
2009/0270872 A1 10/2009 DiMauro
2010/0065154 A1 3/2010 Globerman
2010/0069786 A1 3/2010 Globerman
2010/0152855 A1 6/2010 Kuslich et al.
2010/0168271 A1 7/2010 Beyar
2010/0268231 A1 10/2010 Kuslich et al.
2012/0307586 A1 12/2012 Globerman et al.
2013/0123791 A1 5/2013 Beyar et al.
2013/0261217 A1 10/2013 Beyar et al.
2013/0345708 A1 12/2013 Beyar et al.
2014/0088605 A1 3/2014 Ferreyro et al.
2014/0148866 A1 5/2014 Globerman et al.

FOREIGN PATENT DOCUMENTS

DE 136018 C 11/1902
DE 226956 3/1909
DE 868497 C 2/1953
DE 1283448 11/1968
DE 1810799 6/1970
DE 2821785 11/1979
DE 3003947 8/1980
DE 2947875 4/1981
DE 3443167 6/1986
DE 8716073 3/1988
DE 3817101 11/1989
DE 3730298 2/1990
DE 4104092 8/1991
DE 2933485 9/1991

(56) References Cited

FOREIGN PATENT DOCUMENTS

| | | | |
|---|---|---|---|
| DE | 4016135 | | 3/1992 |
| DE | 4315757 | | 11/1994 |
| DE | 19612276 | | 10/1997 |
| DE | 10258140 | | 7/2004 |
| EP | 20207 | | 6/1908 |
| EP | 486638 | | 6/1938 |
| EP | 0044877 | | 2/1982 |
| EP | 0190504 | | 3/1986 |
| EP | 0177781 | | 4/1986 |
| EP | 0235905 | | 9/1987 |
| EP | 0301759 | | 7/1988 |
| EP | 0242672 | | 9/1989 |
| EP | 0425200 | | 10/1990 |
| EP | 0423916 | | 4/1991 |
| EP | 0475077 | | 3/1992 |
| EP | 0511868 | | 4/1992 |
| EP | 0493789 | | 7/1992 |
| EP | 0581387 | | 2/1994 |
| EP | 0614653 | | 9/1994 |
| EP | 0669100 | | 8/1995 |
| EP | 0748615 | | 12/1996 |
| EP | 0763348 | | 3/1997 |
| EP | 1074231 | | 2/2001 |
| EP | 1095667 | | 5/2001 |
| EP | 1103237 | | 5/2001 |
| EP | 1104260 | | 6/2001 |
| EP | 1 247 454 | A1 | 10/2002 |
| EP | 1464292 | | 10/2004 |
| EP | 1148850 | | 4/2005 |
| EP | 1552797 | | 7/2005 |
| EP | 1570873 | | 9/2005 |
| EP | 1598 015 | | 11/2005 |
| EP | 1148851 | | 5/2006 |
| EP | 1829518 | | 9/2007 |
| EP | 1886647 | | 2/2008 |
| FR | 1548575 | | 10/1968 |
| FR | 2606282 | | 5/1988 |
| FR | 2629337 | | 10/1989 |
| FR | 2638972 | | 5/1990 |
| FR | 2674119 | | 9/1992 |
| FR | 2690332 | | 10/1993 |
| FR | 2712486 | | 5/1995 |
| FR | 2722679 | | 1/1996 |
| GB | 8331 | | 0/1904 |
| GB | 179502045 | | 4/1795 |
| GB | 190720207 | A | 6/1908 |
| GB | 408668 | | 4/1934 |
| GB | 486638 | A | 6/1938 |
| GB | 2114005 | | 8/1983 |
| GB | 2156824 | | 10/1985 |
| GB | 2197691 | | 5/1988 |
| GB | 2268068 | | 1/1994 |
| GB | 2276560 | | 10/1994 |
| GB | 2411849 | | 9/2005 |
| GB | 2413280 | | 10/2005 |
| GB | 2469749 | | 10/2010 |
| JP | S51-134465 | A | 11/1976 |
| JP | 54-009110 | | 1/1979 |
| JP | 55-009242 | U | 1/1980 |
| JP | 55-109440 | | 8/1980 |
| JP | 62-068893 | | 3/1987 |
| JP | 63-194722 | A | 8/1988 |
| JP | 02-122017 | | 5/1990 |
| JP | 02-166235 | | 6/1990 |
| JP | 02-125730 | U | 10/1990 |
| JP | 4 329956 | | 11/1992 |
| JP | 07-000410 | | 1/1995 |
| JP | 8322848 | | 12/1996 |
| JP | 10146559 | | 6/1998 |
| JP | 10-511569 | | 10/1998 |
| JP | 2001-514922 | A | 9/2001 |
| JP | 2004-16707 | | 1/2004 |
| JP | 2005-500103 | A | 1/2005 |
| JP | 2008-55367 | | 3/2008 |
| RO | 116784 | | 6/2001 |
| SU | 662082 | | 5/1979 |
| SU | 1011119 | | 4/1983 |
| SU | 1049050 | | 10/1983 |
| WO | WO 90/00037 | | 1/1990 |
| WO | WO 92/14423 | | 9/1992 |
| WO | WO 94/12112 | | 6/1994 |
| WO | WO 95/13862 | | 5/1995 |
| WO | WO 96/11643 | | 4/1996 |
| WO | WO 96/19940 | | 7/1996 |
| WO | WO 96/32899 | | 10/1996 |
| WO | WO 96/37170 | | 11/1996 |
| WO | WO 97/18769 | | 5/1997 |
| WO | WO 97/28835 | | 8/1997 |
| WO | WO 98/28035 | | 7/1998 |
| WO | WO 98/38918 | | 9/1998 |
| WO | WO 99/18866 | | 4/1999 |
| WO | WO 99/18894 | | 4/1999 |
| WO | WO 99/29253 | | 6/1999 |
| WO | WO 99/37212 | | 7/1999 |
| WO | WO 99/39661 | | 8/1999 |
| WO | WO 99/49819 | | 10/1999 |
| WO | WO 99/52446 | | 10/1999 |
| WO | WO 00/06216 | | 2/2000 |
| WO | WO 00/44319 | | 8/2000 |
| WO | WO 00/44321 | | 8/2000 |
| WO | WO 00/44946 | | 8/2000 |
| WO | WO 00/54705 | | 9/2000 |
| WO | WO 00/56254 | | 9/2000 |
| WO | WO 01/08571 | | 2/2001 |
| WO | WO 01/13822 | | 3/2001 |
| WO | WO 01/54598 | | 8/2001 |
| WO | WO 01/60270 | | 8/2001 |
| WO | WO 01/76514 | | 10/2001 |
| WO | WO 02/00143 | | 1/2002 |
| WO | WO 02/02033 | | 1/2002 |
| WO | WO 02/19933 | | 3/2002 |
| WO | WO 02/064062 | | 8/2002 |
| WO | WO 02/064194 | | 8/2002 |
| WO | WO 02/072156 | | 9/2002 |
| WO | WO 02/096474 | | 12/2002 |
| WO | WO 03/007854 | | 1/2003 |
| WO | WO 03/015845 | | 2/2003 |
| WO | WO 03/022165 | | 3/2003 |
| WO | WO 03/061495 | | 7/2003 |
| WO | WO 03/078041 | | 9/2003 |
| WO | WO 03/101596 | | 12/2003 |
| WO | WO 2004/002375 | | 1/2004 |
| WO | WO 2004/019810 | | 3/2004 |
| WO | WO 2004/071543 | | 8/2004 |
| WO | WO 2004/075965 | | 9/2004 |
| WO | WO 2004/080357 | | 9/2004 |
| WO | WO 2004/110292 | | 12/2004 |
| WO | WO 2004/110300 | | 12/2004 |
| WO | WO 2005/000138 | | 1/2005 |
| WO | 2005/017000 | A1 | 2/2005 |
| WO | WO 2005/032326 | | 4/2005 |
| WO | WO 2005/048867 | | 6/2005 |
| WO | WO 2005/051212 | | 6/2005 |
| WO | WO 2005/110259 | | 11/2005 |
| WO | WO 2006/011152 | | 2/2006 |
| WO | WO 2006/039159 | | 4/2006 |
| WO | 2006/062939 | A2 | 6/2006 |
| WO | WO 2006/090379 | | 8/2006 |
| WO | WO 2007/015202 | | 2/2007 |
| WO | WO 2007/036815 | | 4/2007 |
| WO | WO 2007/148336 | | 12/2007 |
| WO | WO 2008/004229 | A2 | 1/2008 |
| WO | WO 2008/032322 | | 3/2008 |
| WO | WO 2008/047371 | | 4/2008 |

OTHER PUBLICATIONS

Mendizabal et al., Modeling of the curing kinetics of an acrylic bone cement modified with hydroxyapatite. International Journal of Polymeric Materials. 2003;52:927-938.

Morejon et al., Kinetic effect of hydroxyapatite types on the polymerization of acrylic bone cements. International Journal of Polymeric Materials. 2003;52(7):637-654.

(56) References Cited

OTHER PUBLICATIONS

Sreeja et al., Studies on poly(methyl methacrylate)/polystyrene copolymers for potential bone cement applications. Metals Materials and Processes. 1996;8(4):315-322.
Yang et al., Polymerization of acrylic bone cement investigated by differential scanning calorimetry: Effects of heating rate and TCP content. Polymer Engineering and Science. Jul. 1997;1182-1187.
Baroud, G., "Influence of Mixing Method on the Cement Temperature-Mixing Time History and Doughing Time of Three Acrylic Cements for Vertebroplasty," Wiley Periodicals Inc. 112-116 (2003).
European Search Report, from EP 10182769.9, mailed Mar. 2, 2011.
European Search Report, from EP 10182693.1, mailed Mar. 2, 2011.
European Search Report, from EP 10192302.7, mailed Mar. 24, 2011.
European Search Report, from EP 10192301.9, mailed Mar. 24, 2011.
European Search Report, from EP 10192300.1, mailed Mar. 24, 2011.
Hide, I. et al., "Percutaneous Vertebroplasty: History, Technique and current Perspectives," Clin. Radiology 59:461-67 (2004).
Hu, M. et al., "Kyphoplasty for Vertebral Compression Fracture Via a Uni-Pedicular Approach," Pain Phys. 8:363-67 (2005).
Liang, B. et al., "Preliminary Clinical Application of Percutaneous Vertebroplasty," Zhong Nan Da Xue Bao Yi Xue Ban 31(1):114-9 (2006)(abs. only).
Noetzel, J. et al., Calcium Phosphate Cements in Medicine and Denistry—A Review of Literature, Schweiz Monatsschr Zehmed 115(12):1148-56 (2005)(abs. only).
Supp. EP Search Report, from EP Appl. No. 07766863.0, dated Apr. 12, 2011.
International Search Report, from corresponding PCT/IL07/00833, dated Apr. 4, 2008.
International Search Report, from corresponding PCT/IL07/01257, dated Jul. 15, 2008.
Krause, "The Viscosity of Acrylic Bone Cements," J. Biomed. Mat. Res. 16:219 (1982).
International Search Report, for PCT/IL07/00808, issued Aug. 22, 2008.
Supp. EP Search Report, from EP 07766838.2, dated May 18, 2011.
Cromer, A., "Fluids," Physics for the Life Sciences, 2:136-37 (1977).
JP Office Action, from JP Appl No. 2008-532910, mailed Jul. 19, 2011.
Lindeburg, M., "External Pressurized Liquids," Mechanical Eng. Ref. Manual for the PE Exam, 10:15-14(May 1997).
Marks, Standard handbook for mechanical engineers, section 5 (Tenth ed. 1996).
JP Office Action, from JP Appl No. 2009-517607, mailed Aug. 9, 2011.
European Search Report, from EP07827231.7, mailed Sep. 12, 2011.
Japanese Office Action issued Feb. 21, 2012 for Application No. 2009-516062 (6 Pages).
Australian Office Action issued Jun. 18, 2012 for Application No. 2007311451 (3 pages).
Australian Office Action issued Mar. 7, 2013 for Application No. 2012203300 (6 pages).
Japanese Office Action issued Apr. 9, 2013 for Application No. 2007-556708.
Kuehn et al., Acrylic bone cements: composition and properties. Orthop Clin North Am. Jan. 2005;36(1):17-28, v.
Japanese Office Action for Application No. 2009-517607, dated Aug. 27, 2013. (6 pages).
Japanese Interrogation for Application No. 2009-516062 (Appeal No. 2013-002371) issued Jul. 9, 2013 (9 Pages).
Lu Orthopedic Bone Cement Biomechanics and Biomaterials in Orthopedics. Ed. Poitout London: Springer-Verlag London Limited 2004 86-88.
European Search Report for Application No. 13174874.1, issued Nov. 13, 2013 (6 pages).
[No Author Listed] Plastic Deformation of Metals and Related Properties. New Age Publishers. p. 1-29.
European Search Report for Application No. 12181745.6, issued Sep. 25, 2012. (9 pages).
Japanese Office Action for Application No. 2009-517607, dated Feb. 4, 2014. (8 pages).
Japanese Office Action for Application No. 2009-517607, dated Aug. 28, 2012. (4 pages).
Japanese Office Action for Application No. 2009-516062, dated Oct. 16, 2012 (6 pages).
Extended European Search Report for Application No. 14166420.1, issued Jul. 14, 2014 (9 pages).
Al-Assir, et al., "Percutaneous Vertebroplasty: A Special Syringe for Cement Injection," AJNR Am. J. Neuroradiol. 21:159-61 (Jan. 2000).
Amar, Arun P. et al., "Percutaneous Transpedicular Polymethylmethacrylate Vertebroplasty for the Treatment of Spinal Compression Fractures," Neurosurgery 49(5):1105-15 (2001).
Andersen, M. et al., "Vertebroplastik, ny behandling of osteoporotiske columnafrakturer?", Ugeskr Laefer 166/6:463-66 (Feb. 2, 2004).
Avalione & Baumeister III, Marks' Standard Handbook for Mechanical Engineers, 10 ed, pp. 5-6 (1996).
Baroud et al., "Injection Biomechanics of Bone Cements Used in Vertebroplasty," Biomed. Mat. & Eng. 00:1-18 (2004).
Barr, J.D., "Percutaneous Vertebroplasty for pain Relief and Spinal Stabilization," Spine 25(8):923-28 (2000).
Belkoff, S. et al., The Biomechanics of Vertebroplasty, the Effect of Cement Volume on Mechanical Behavior, Spine 26(14):1537-41 (2001).
Belkoff, S.M. et al., "An Ex Vivo Biomechanical Evaluation of a Hydroxyapatite Cement for Use with Kyphoplasty," Am. J. Neurorad. 22:1212-16 (2001).
Belkoff, S.M. et al., "An Ex Vivo Biomechanical Evaluation of a Inflatable Bone Tamp Used in the Treatment of Compression Fracture," Spine 26(2):151-56 (2001).
Belkoff, S.M. et al., "An in Vitro Biomechanical Evaluation of Bone Cements Used in Percutaneous Vertebroplasty," Bone 25(2):23S-26S (1999).
Blinc, A et al., "Methyl-methacrylate bone cement surface does not promote platelet aggregation or plasma coagulation in vitro," Thrombosis Research 114:179-84 (2004).
Bohner, M. et al., "Theoretical and Experimental Model to Describe the Injection of a Polymethacrylate Cement into a Porous Structure," Biomaterials 24(16):2721-30 (2003).
Breusch, S. et al., "Knochenzemente auf Basis von Polymethylmethacrylat," Orthopade 32:41-50 (2003) w/ abs.
Canale et al., "Campbell's operative orthopaedic—vol. 3—ninth ed", Mosby:p. 2097,2121,2184-2185,2890-2896, (1998) abstracts.
Carrodegus et al., "Injectable Acrylic Bone Cements for Vertebroplasty with Improved Properties," J. Biomed. Materials Res. 68(1):94-104 (Jan. 2004).
Codman & Shurtleff, "V-MAX™ Mixing and Delivery Device," Catalog No. 43-1056.
Cole et al., "AIM Titanium Humeral Nail System," Surgical Technique. DePuy Orthopaedics 17P (2000).
Combs, S. et al., "The Effects of Barium Sulfate on the Polymerization Temperature and Shear Strength of Surgical Simplex P," Clin. Ortho. and Related Res. pp. 287-291 (Jun. 4, 1979).
Cotton, A. et al., "Percutaneous Vertebroplasty: State of the Art," Scientific Exhibit, Radiographics 18:311-20 (1998).
Dean, J.R. et al., "The Strengthening Effect of Percutaneous Vertebroplasty," Clin Radiol. 55:471-76 (2000).
Deramond, H. et al, "Percutaneous Vertebroplasty with Polymethylmethacrylate, Technique Indications and Results," Radiologic Clinics of North America 36(3) (May 1988).
Deramond, H. et al., "Temperature Elevation Caused by Bone cement Polymerization During Vertbroplasty," Bone 25(2):17S-21S (1999).
DeWijn, J.R., Characterization of Bone Cements, The Institute of Dental Materials Science and Technology and the Dept of Ortho., Catholic University, Netherlands 46:38-51 (1975).
Edeland, "Some additional suggestions for an intervertebral disc prothesis," J. Biomed. Eng. XP008072822, 7(1):57-62 (1985.
European Search Report, from EP05763930.4; mailed Sep. 11, 2008.
European Search Report, from EP09151379.6, mailed Oct. 20, 2009.
European Search Report, from EP06780252.0, mailed Oct. 29, 2009.

(56) References Cited

OTHER PUBLICATIONS

Farrar, D.F. et al., "Rheological Properties of PMMA Bone Cements During Curing," Biomaterials 22:3005-13 (2001).
Feldman, H., "Die Geschichte der Injektionen," Laryngo-Rhino-Othol 79:239-46 (2000).
Fessler, Richard D. et al., "Vertebroplasty," Neurosurgical Operative Atlas 9:233-240 (2000).
Gangi, A., "CT-Guided Interventional Procedures for Pain Management in the Lumbosacral Spine," Radiographics 18:621-33 (1998).
Gangi, A., "Computed Tomography CT and Fluoroscopy-Guided Vertebroplasty: Results and Complications in 187 Patients," Seminars in Interventional Radiology 16(2):137-42 (1999).
Gangi, A., "Percutaneous Vertebroplasty Guided by a Combination of CT and Fluoroscopy," AJNR 15:83-86 (1994).
Garfin, S. R. et al., "New Technologies in Spine, Kyphoplasty and Vertebroplasty for the Treatment of Painful Osteoporotic Compression Fractures," Spine 26(14:1511-15 (2001).
Gheduzzi, S. et al., "Mechanical Characterisation of Three Percutaneous Vertebroplasty Biomaterials," J. Mater Sci Mater Med 17(5):421-26 (2006).
Giannitsios, D. et al., "High Cement Viscosity Reduces Leakage Risk in Vertebroplasty," European Cells & Mat. 10 supp. 3:54 (2005).
Glasgow Medico-Chirurgical Society, The lancet 1364 (May 18, 1907).
Grados F. et al.,"Long-Term Observations of Vertebral Osteoporotic Fractures Treated by Percutaneous Vertebroplasty," Rheumatology 39:1410-14 (2000).
Greenberg "Filling Root Canals by an Injection Technique," Dental Digest 61-63 (Feb. 1963).
Greenberg, "Filling Root Canals in Deciduous Teeth by an Injection Technique," Dental Digest 574-575 (Dec. 1961).
Greig, D., "A New Syringe for Injecting Paraffin," The Lancet 611-12 (Aug. 29, 1903).
Hasenwinkel, J. et al., "A Novel High-Viscosity, Two-Solution Acrylic Bone Cement: Effect of Chemical Composition on Properties," J. Biomed. Materials Research 47(1):36-45 (1999).
Hasenwinkel, J. et al., "Effect of Initiation Chemistry on the Fracture Toughness, Fatigue Strength, and Residual Monomer Content of a Novel High-Viscosity, Two-Solution Acrylic Bone Cement," J. Biomed. Materials Res. 59(3):411-21 (2001).
Heini, P. et al., "Augmentation of Mechanical Properties in Osteoporatic Vertebral Bones—A Biomechanical Investigation of Vertebroplasty Efficacy With Different Bone Cements," EUR Spine J. v. 10, pp. 164-171, Springer-Verlag (2001).
Heini, P., "Percutaneous Transpedicular Vertebroplasty with PMMA: Operative Technique and Early Results," EUR Spine J. v. 9, pp. 445-450, Springer-Verlag (2000).
Heini et al., "The Use of a Side-Opening Injection Cannula in Vertebroplasty," Spine 27(1):105-09 (2002).
Heraeus Palacos R, 2008, Palacos R, high Viscosity Bone Cement.
Hernandez et al., "Influence of Powder Particle Size Distribution on Complex Viscosity and Other Properties of Acrylic Bone Cement for Vertebroplasty and Kyphoplasty," J. Biomed. Mat. Res. 77B:98-103 (2006).
International Preliminary Report on Patentability, from PCT/IB06/053014, dated Apr. 10, 2008.
International Search Report, from PCT/IL06/00239, mailed Jan. 26, 2007.
International Search Report, from PCT/IL05/00812, mailed Feb. 28, 2007.
International Search Report, from PCT/IB06/052612, mailed Oct. 2, 2007.
International Search Report, from PCT/IL07/00484, mailed Apr. 17, 2008.
International Search Report, for PCT/MX03/000027, filed Mar. 14, 2003.
Ishikawa et al., "Effects of Neutral Sodium Hydrogen Phosphate on Setting Reaction and Mechanical Strength of Hydroxyapatite Putty," J. Biomed. Mat. Res. 44:322-29 (199).
Ishikawa et al., "Non-Decay Type Fast-Setting Calcium Phosphate Cement: Hydroxyapatite Putty Containing an Increased Amount of Sodium Alginate," J. Biomed. Mat. Res. 36:393-99 (1997).
Jasper, L.E. et al., "The Effect of Monomer-to-Powder Ratio on the Material Properties of Cranioplastic," Bone 25(2):27S-29S (1999).
Jensen, Mary E. et al., "Percutaneous Polymethylmethacrylate Vertebroplasty in the Treatment of Osteoporotic Vertebral Body Compression Fractures: Technical Aspects," AJNR 18:1897-1904 (1997).
Jensen, Mary E. et al., "Percutaneous Vertebroplasty in the Treatment of Osteoporotic Compression Fractures," Spine Interventions 10(3):547-568 (2000).
Johnson & Johnson Orthopaedics, The CEMVAC Method, Raynham, MA.
Kallmes, D. et al., "Radiation Dose to the Operator During Vertebroplasty: Prospective Comparison of the Use of 1-cc Syringes Versus an Injection Device," AJNR Am. J. Neuroradiol. 24:1257-60 (2003).
Kaufmann et al, "Age of Fracture and Clinical Outcomes of Percutaneous Vertebroplasty," Am. J. Neuroradiology 22:1860-63 (2001).
Kuhn, Klaus-Dieter, Bone Cements—Uptodate Comparison of Physical and Chemical Properties of Commercial Materials, Springer-Verlag Heidelberg Germany p. 7-8, 17, 38 (2000).
Kyphom Medical Professionals, KyphXProducts (Nov. 8, 2001).
Lake, R., "The Restoration of the Inferior Turbinate Body by Paraffin Injections in the Treatment of Atrophic Rhinitis," The Lancet 168-69 (Jan. 17, 1903).
Lewis, "Properties of Acrylic Bone Cement: State of the Art Review," J. Biomed. Mat. Res. Appl. Biomaterials 38(2):155-82 (p. 158 s.Viscosity) (1997).
Lewis, G. et al., "Rheological Properties of Acrylic Bone Cement During Curing and the Role of the Size of the Powder Particles," J. Biomed. Mat. Res. Appl. Biomat. 63(2):191-99 (2002).
Lewis, "Toward Standardization of Methods of Determination of Fracture Properties of Acrylic Bone Cement and Statistical Analysis of Test Results," J. Biomed. Research: Appl. Biomaterials 53(6):748-68 (2000).
Li, C. et al., "Thermal Characterization of PMMA-Based Bone Cement Curing," J. Materials Sci.: Materials in Medicine 15:84-89 (2004).
Lieberman, I.H. et al., "Initial Outcome and Efficiacy of Kyphoplasty in the Treatment of Painful Osteoporatic Vertebral Compression Fractures," Spine 26(14:1631-38 (2001).
Mathis, John et al., "Percutaneous Vertebroplasty: A Developing Standard of Care for Vertebral Compression Fractures," AJNR Am. J. Neurorad. 22:373-81 (2001).
Medsafe Palacos R 2007, Data Sheet : Palacos R Bone cement with Garamycin pp. 1-7; http://www.medsafe.govt.nz/profs/datasheet/p/palacosbonecements.htm.
Mousa, W.F. et al., "Biological and Mechanical Properties of PMMA-Based Bioactive Bone Cements," Biomaterials 21:2137-46 (2000).
Nussbaum et al., "The Chemistry of Acrylic Bone Cements and Implications for Clinical Use in Image-Guided Therapy," J. Vasc. Interv. Radiol. 15:121-26 (2004).
O'Brien, J. et al., "Vertebroplasty in patients with Severe Vertebral Compression Fractures: A Technical Report," AJNR 21:1555-58 (2000).
Odian, G., "Principles of Polymerization," pp. 20-23.
Padovani, B. et al., "Pulmonary Embolism Caused by Acrylic Cement: A Rare Complication of Percutaneous Vertebroplasty," AJNR 20:375-77 (1999).
Paget, S., "The Uses of Paraffin in Plastic Surgery," The Lancet 1354 (May 16, 1903).
Parallax Medical, Inc., Exflow Cement Delivery System (May 16, 2000).
Pascual, B. et al., "New Aspects of the Effect of Size and Size Distribution on the Setting Parameters and Mechanical Properties of Acrylic Bone Cements," Biomaterials 17(5):509-16 (1996).
Rimnac, CM, et al., "The effect of centrifugation on the fracture properties of acrylic bone cements," JB&JS 68A(2):281-87 (1986).

(56) References Cited

OTHER PUBLICATIONS

Robinson, R. et al., "Mechanical Properties of Poly(methyl methacrylate) Bone Cement," J. Biomed. Materials Res. 15(2):203-08 (2004).
Ryu, K. S. et al., "Dose-Dependent Epidural Leakage of Polymethylmethacrylate after Percutaneous Vertebroplasty in Patients with Osteoporotic Vertebral Compression Fractures," J. Neuro: Spine 96:56-61 (2002).
Saha, S. et a., "Mechanical Properties of Bone Cement: A Review," J. Biomed. Materials Res. 18(4):435-62 (1984).
Serbetci, K. et al., "Thermal and Mechanical Properties of Hydroxyapatite Impregnated Acrylic Bone Cements," Polymer Testing 23:145-55 (2004).
Shah, T., Radiopaque Polymer Formulations for Medical Devices; Medical Plastics and Biomaterials Special Section; Medical Device & Diagnostic Industry pp. 102-111 (2000).
Steen, "Laser Surface Treatment," Laser Mat. Processing, Springer 2d ed. ch. 6:218-71 (2003).
Supp. EP Search Report, from EP Appl. No. 05763930.4, dated Sep. 11, 2008.
Supp. EP Search Report, from EP Appl. No. 06711221.9, dated Sep. 15, 2008.
Varela et al., "Closed Intramedullary Pinning of Metacarpal and Phalanx Fractures," Orthopaedics 13(2):213-15 (1990).
Vasconcelos, C., "Transient Arterial Hypotension Induced by Polymethyacrylated Injection During Percutaneous Vertebroplasty," Letter to the Editor, JVIR (Aug. 2001).
Walton, A, "Some Cases of Bone Cavities Treated by Stopping With Paraffin," The Lancet 155 (Jan. 18, 1908).
Weissman et al., "Trochanteric Fractures of the Femur Treatment with a Strong Nail and Early Weight-Bearing," Clin. Ortho. & Related Res. 67:143-50 (1969).
Wimhurst, J.A., et al., "The Effects of Particulate Bone Cements at the Bone-Implant Interface," J. Bone & Joint Surgery pp. 588-592 (2001).
Wimhurst, J.A. et al., "Inflammatory Responses of Human Primary Macrophages to Particulate Bone Cements in Vitro," J. Bone & Joint Surgery 83B:278-82 (2001).
Zapalowicz, K. et al., "Percutaneous Vertebroplasty with Bone Cement in the Treatment of Osteoporotic Vertebral Compression Fractures," Ortopedia Traumatologia Rehabilitacja NR Jan. 2003.

* cited by examiner

FLUID DELIVERY SYSTEM

RELATED APPLICATION

This application claims the benefit under 119(e) of U.S. 60/862,163 filed 19 Oct. 2006, the disclosure of which is incorporated herein by reference.

FIELD OF THE INVENTION

The present invention relates to fluid delivery systems, for example, to fluid delivery systems adapted to dispense fluids into mixing chambers.

BACKGROUND OF THE INVENTION

Mechanical mixers for mixing components to homogeneity are well known. Their applications include, but are not limited to baking, building construction and medicine.

Mixing apparatus for high viscosity mixtures are typically adapted to provide sufficient shear force to continue moving against great resistance. In some cases, the resistance increases during mixing because the viscosity of the mixture increases.

One example of a case where the viscosity of the mixture increases during mixing is preparation of a polymer/monomer mixture. When a polymer and monomer are combined, a polymerization reaction begins. The polymerization reaction increases the average polymer chain length in the mixture and/or causes cross-linking between polymer chains. Increased polymer chain length and/or cross linking between polymer chains contribute to increased viscosity.

Polymerization mixtures are often employed in formulation of bone cement. One common polymer/monomer pair employed in bone cement formulation is polymethylmethacrylate/methylmethacrylate (PMMA/MMA). Because PMMA/MMA bone cements typically set to a solid form, reaction conditions for the polymerization reaction are generally adjusted so that mixing PMMA and MMA produces a liquid phase which lasts several minutes. This is typically achieved by mixing a monomer liquid including MMA and, optionally DMPT and/or HQ, with a polymer powder including PMMA and, optionally Barium Sulfate and/or BPO and/or styrene. Typically, known mixing apparatuses are constructed for use with a liquid polymerization mixture and may not be suitable for mixing of highly viscous cements that have substantially no liquid phase during mixing.

One problem that is typically encountered with some prior art systems derives from the delivery and transfer of the liquid and powder components of the bone cements into the mixing apparatus. These components must be kept separate from each other until the user is ready to mix them. Typically, the dry powder is stored in a flexible bag, while the liquid monomer is stored for shipment and handling in a vial or an ampoule, usually formed from glass; both require opening and pouring into a mixing well prior to mixing. Typically the liquid monomer has a foul odor.

U.S. Pat. No. 6,572,256 to Seaton et al, the disclosure of which is fully incorporated herein by reference, describes a fluid transfer assembly detachably coupled to a mixing vessel. The assembly is designed to dispense a liquid monomer component from a sealed unit in a closed loop operation. The closed-loop operation is facilitated by a vacuum source connected to the mixing vessel though a portal and used as a driving force to suck liquid out of the sealed unit once pierced by a hollow needle.

SUMMARY OF THE INVENTION

An aspect of some embodiments of the present invention is the provision of a fluid delivery system for dispensing a liquid from a sealed container, e.g. a vial and/or a sealed tube, directly into a closed chamber, e.g. a mixing chamber, using an open loop operation. According to some embodiments of the present invention, the open loop operation includes manual operation and/or gravity. According to some embodiments of the present invention, a receiving port of the closed chamber receives the liquid in direct response to manual insertion of the sealed container through the receiving port using an open loop system. According to some embodiments of the present invention, manual operation is used to directly control the amount of liquid dispensed and/or the rate at which the liquid is dispensed. According to some embodiments of the present invention, the amount of liquid dispensed and the rate of dispensing the liquid can be manually controlled. According to some embodiments of the present invention, the sealed container is detachably coupled to the mixing chamber. According to other embodiments of the present invention, the sealed container is an integral part of the mixing chamber.

An aspect of some embodiments of the present invention is the provision of a sealed container adapted to dispense a contained liquid once engaged onto a receiving port of a closed chamber. According to some embodiments of the present invention, the sealed unit includes a housing adapted to contain a liquid and a seal adapted to seal the liquid contained within the housing. According to some embodiments of the present invention, the seal is configured for piercing and/or rupturing, e.g. by a hollow needle, to open a channel for dispensing the liquid. According to some embodiments of the present invention, the seal is a perforated, weakened or pressure sensitive seal, e.g. have at least one through hole designed to allow leakage under predetermined pressures, which are substantially higher than the nominal lower inner pressure of the container. According to some embodiments of the present invention, the seal is a retractable seal that that can be retracted with respect to the housing so as to push out the liquid through the opened channel, e.g. through the hollow needle piercing the seal. According to some embodiments of the present invention the housing of the sealed unit is adapted for telescopically mounting the housing onto a reception port of the chamber. According to some embodiments of the present invention, the liquid is a liquid component of bone cement.

An aspect of some embodiments of the present invention is the provision of a closed chamber including a receiving port for receiving a liquid from a sealed container. According to some embodiments of the present invention, the chamber is adapted for telescopically engaging the sealed container onto the receiving port. According to some embodiments of the present invention, the receiving port is associated with and/or includes a rupture mechanism for rupturing a seal of the sealed container. According to some embodiments of the present invention, the receiving port includes a base for supporting the seal of the sealed container in place as a user collapses the telescopic engagement between the container and the port. According to some embodiments of the present invention, supporting the seal as the vial is being pushed affects retraction of the seal with respect to the housing of the container and facilitates pushing the liquid out of the container and into the mixing chamber. According to some embodiments of the present invention, the chamber is a mixing chamber for mixing a liquid and powder component of bone cement. According to some embodiments of the present invention, the chamber is predisposed with the powder component of bone cement and the liquid component is added upon demand.

An aspect of some embodiments of the present invention provides a fluid delivery system for dispensing a liquid from a sealed container directly into a closed chamber comprising a container containing a liquid component of bone cement and plugged with a plug, and a closed chamber comprising a receiving port for receiving the sealed container, wherein the receiving port is configured to receive the liquid component in direct response to manual insertion of the sealed container through the receiving port using an open loop system.

Optionally, the plug is configured for retracting into the sealed container during the dispensing.

Optionally, the plug is configured for retracting through the sealed container in response to manually exerted pressure.

Optionally, the plug includes a defined area configured for puncturing, wherein the defined area includes at least one blind hole.

Optionally, the receiving port includes a hollow protrusion to telescopically receive the fluid container.

Optionally, the receiving port includes a supporting element configured to support the plug at a defined height.

Optionally, the closed chamber is a mixing chamber.

Optionally, the mixing chamber is configured for mixing bone cement having a viscosity above 500 Pascal/second.

An aspect of some embodiments of the present invention provides a sealed container comprising a housing comprising an open end and configured for containing a liquid monomer, and a sealing member configured to plug the open end, wherein the sealing member includes a self-rupturing mechanism.

Optionally, the sealing member includes a piercing element and a sealing membrane, wherein the piercing element is distanced from the sealing membrane in the absence of pressure exerted on the sealing member and wherein the piercing element is configured to engage the sealing membrane in the response to predefined pressure exerted on the sealing member.

Optionally, the piercing element is a hollow needle.

Optionally, the self-rupturing mechanism includes a burst valve.

Optionally, the self-rupturing mechanism includes a collapsible orifice.

Optionally, the collapsible orifice opens in response to pressure exerted on the sealing member.

Optionally, the housing is configured for being telescopically mounted onto a reception port of a mixing chamber.

Optionally, the housing includes screw threads configured for advancing the container through a receiving port of a mixing chamber by threaded rotation.

Optionally, the housing is fabricated from a material that is transparent relatively to the liquid monomer.

Optionally, the sealed container comprises scale marks configured for manually monitoring the volume of the liquid.

An aspect of some embodiments of the present invention provides, a mixing chamber comprising a chamber body configured for containing components to be mixed and for mixing the components, a cover configured for sealing the chamber body, and a receiving port integrated onto the cover configured for telescopically engaging a plugged end of a fluid container including a plug and containing a liquid component of bone cement into the receiving port and for manually dispensing the liquid directly into the chamber body.

Optionally, the receiving port includes a channel for directing liquid from the fluid container into the mixing chamber.

Optionally, the receiving port includes a plurality of channels for evenly distributing the liquid throughout the mixing chamber.

Optionally, the receiving port includes a puncture driving mechanism configured to facilitate puncturing of the plug.

Optionally, the receiving port includes a support element for holding the plug in place as the fluid container is manually advanced through the receiving port.

Optionally, the receiving port includes screw threads configured to engage the fluid container with threaded rotation.

Optionally, the mixing chamber is configured for mixing bone cement having a viscosity above 500 Pascal/second.

Optionally, the fluid container is an integral part of the mixing chamber.

Optionally, the mixing chamber comprises a holder configured to prevent undesired backwards movement of the fluid container through the receiving port.

An aspect of some embodiments of the present invention provides a method for dispensing a liquid from a sealed container directly into a closed chamber, the method comprising receiving a plugged end of a fluid container containing liquid though a port of the closed chamber, puncturing the plugged end, and supporting the plugged end in place as the fluid container is manually pushed through the port affecting leakage of the liquid through the punctured plugged end.

Optionally, the fluid container is telescopically received into the port of the closed container.

Optionally, the method comprises dispensing the liquid directly into the closed chamber without exposing the liquid to the environment surrounding the closed chamber.

Optionally, the closed chamber is pre-disposed with a powder component of bone cement and wherein the fluid container is pre-disposed with a liquid component of bone cement.

Optionally, the method comprises channeling the liquid into the mixing chamber.

An aspect of some embodiments of the present invention provides, a method for dispensing a liquid monomer from a sealed container directly into a closed mixing chamber comprising inserting a plugged fluid container containing a liquid monomer into a receiving port of a closed mixing chamber, and puncturing the plugged end of the fluid container by advancing the fluid container through the receiving port.

Optionally, the advancing is by threaded rotation.

Optionally, the method comprises monitoring the amount of liquid dispensed into the chamber.

Optionally, monitoring includes visually monitoring.

Optionally, the method comprises mixing the liquid dispensed in the mixing chamber with a powder component of bone cement.

BRIEF DESCRIPTION OF THE DRAWINGS

The subject matter regarded is particularly and distinctly claimed in the concluding portion of the specification. Non-limiting examples of embodiments of the present invention are described below with reference to figures attached hereto, which are listed following this paragraph. In the figures, identical structures, elements or parts that appear in more than one figure are generally labeled with a same symbol in all the figures in which they appear. Dimensions of components and features shown in the figures are chosen for convenience and clarity of presentation and are not necessarily shown to scale. For example, the dimensions of some of the elements may be exaggerated relative to other elements for clarity.

Figure 1B:
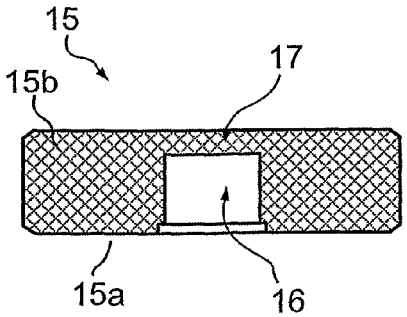
FIGS. 1B to 1E are schematic illustrations of additional sealing members that may be used for the fluid container shown in FIG. 1A according to some embodiments of the present invention.

It will be appreciated that for simplicity and clarity of illustration, elements shown in the figures have not necessarily been drawn to scale. Further, where considered appropriate, reference numerals may be repeated among the figures to indicate corresponding or analogous elements.

DETAILED DESCRIPTION OF EXEMPLARY EMBODIMENTS

In the following description, exemplary, non-limiting embodiments of the invention incorporating various aspects of the present invention are described. For purposes of explanation, specific configurations and details are set forth in order to provide a thorough understanding of the embodiments. However, it will also be apparent to one skilled in the art that the present invention may be practiced without the specific details presented herein. Furthermore, well-known features may be omitted or simplified in order not to obscure the present invention. Features shown in one embodiment may be combined with features shown in other embodiments. Such features are not repeated for clarity of presentation. Furthermore, some unessential features are described in some embodiments.

Exemplary Fluid Container

Figure 1C:
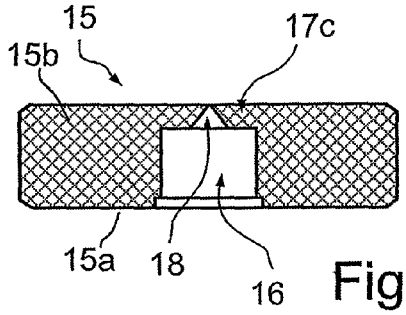
Figure 1D:
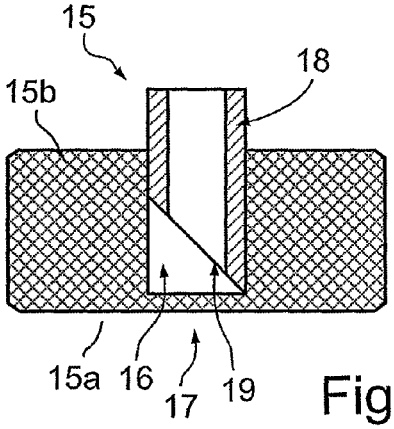
Figure 1E:
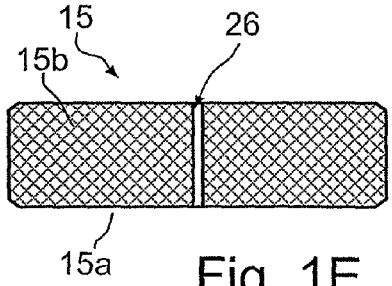
Figure 1A:
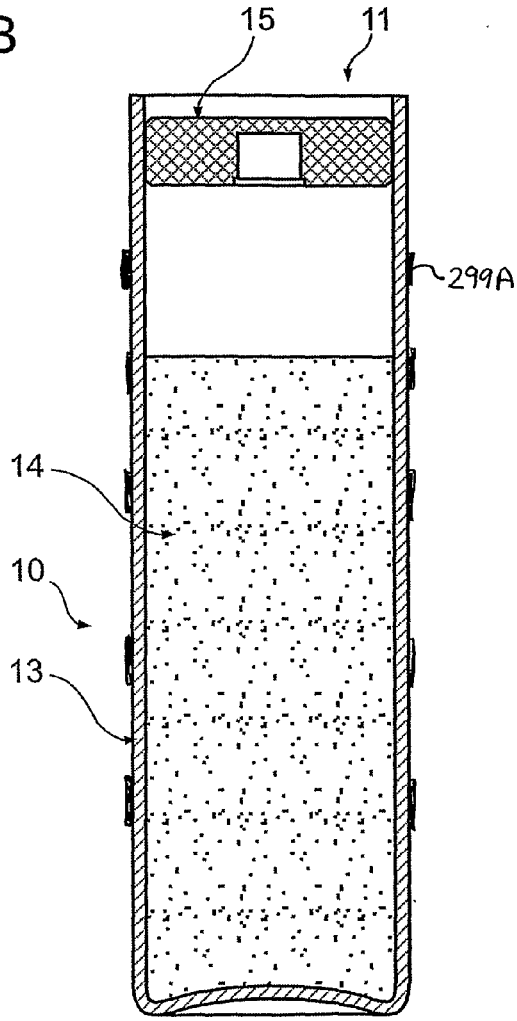
FIG. 1A is schematic illustration a fluid container including a sealing member according to some embodiments of the present invention.

Reference is now made to FIG. 1A showing schematic illustration a fluid container including a slidable seal according to some embodiments of the present invention. According to some embodiments of the present invention, fluid container 10 includes a housing 13, e.g. a tube shaped housing, containing a fluid 14. Typically housing 13 includes an open end 11 that is sealed with a sealing member 15, e.g. a plug and/or plunger. For example, fluid container 10 may be a vial and/or a plugged tube. Optionally, housing 13 may include screw threads 299A on the outer face of the housing.

According to some embodiments of the invention, housing 13 is tubular in shape with a uniform inner cross section along at least part of its length, e.g. a uniform circular cross section. According to some embodiments of the present invention, housing 13 has a volume that can contain between approximately 5 ml to 50 ml, e.g. 10 ml or 20 ml of fluid.

Typically, housing 13 is fabricated from a material that is rigid, transparent and resistant to liquid monomers, e.g. Methylmethacrylate. In some exemplary embodiments, housing 13 is fabricated from glass, plastic material, e.g. Nylon, and/or Stainless steel. In some exemplary embodiments, housing 13 includes scale marks for manually monitoring the volume and/or the mass of the contained fluid. In some exemplary embodiments, the scale marks include numbers and/or quantities.

Typically, fluid 14 contained in fluid container 10 is a liquid, e.g. a liquid monomer. According to some embodiments of the present invention, fluid 14 is an active and/or hazardous material. In some exemplary embodiments, fluid 14 includes a bone cement monomer, e.g. monomer comprising Methylmethacrylate.

According to some embodiments of the present invention, sealing member 15 is a tubular and/or disk shaped component and/or membrane, e.g. a piston and/or plug, that is adapted to slide along the length of housing 13, e.g. half the length and/or the entire length, while maintaining the seal along its perimeter. Typically, the cross section shape and dimensions of sealing member 15 substantially correspond to the inner dimensions of housing 13. Optionally, sealing member 15 may have an outer diameter that is slightly larger than the inner diameter of housing 13 so that mounting and/or sliding into housing 13 may be preformed under a compressive force, e.g. a minimal compressive force. According to some embodiments of the present invention, the sealing member is designed to fit snugly in at least 3 points to prevent trans-axial motion of the sealing member with respect to the housing.

According to embodiments of the present invention, sealing member 15 is fabricated from a material that is resistant and/or compatible with liquid monomers, e.g. Nylon. According to some embodiments of the present invention, at least a portion of sealing member 15 is adapted to be punctured and/or ruptured to facilitate dispensing the contained fluid.

Reference is now made to FIGS. 1B to 1E showing schematic illustrations of sealing members that may be used for the exemplary fluid container shown in FIG. 1A according to some embodiments of the present invention. According to some embodiments of the present invention, sealing member 15 may include a self-rupturing mechanism and/or operate as a valve having a "closed state", e.g. a pre-ruptured state and an "open state", e.g. a post-ruptured state. For example, sealing member 15 may function as a burst valve.

In FIG. 1B and FIG. 1C, exemplary sealing members 15 include an inner facing surface 15*a* and an outer facing surface 15*b* where inner and outer facing are with respect to housing 13 when the sealing member is positioned in the housing. According to some embodiments of the present invention, sealing member 15 includes at least one blind hole 16, sealed by at least one sealing membrane 17. Typically, sealing membrane 17 is positioned in proximity to the outer surface of sealing member 16. Rupture of sealing membrane 17 may be facilitated by contact with a sharp edge of an object, e.g. a needle piercing the membrane. Typically, sealing membrane 17 is adapted to rupture under a pre-defined compressive force, e.g. a manually exerted pre-determined force.

In FIG. 1C sealing membrane 15 includes a sealing membrane 17 which is weakened in drill 18. In some exemplary embodiments, membrane 15 includes a self-puncturing element, drill 18. In some exemplary embodiments, drill 18 is a conic blind drill that partially advances blind hole 16 into membrane 17. According to some embodiments of the present invention, puncturing results from build up of inner pressure that serves to burst membrane 17, most probably through drill 18.

In FIG. 1D sealing member 15 includes a self-rupturing mechanism. According to some embodiments of the present invention, sealing member 15 includes a blind hole 16, sealing membrane 17 proximal to inner facing surface 15*a* of sealing membrane 15, and piercing element, e.g. a hollow needle 18 inserted through outer facing surface 15*b* and including a sharp end 19 facing sealing membrane 17. In some exemplary embodiments, needle 18 is partially projected out of the outer facing surface 15*b* of sealing member 15 and may have a blunt end 20 facing the outside of housing 13. Typically, sharp end 19 is positioned at a pre-defined distance from sealing membrane 17. Puncturing may be achieved by, for example, pressing the blunt end of needle against a rigid support until contact between the sealing support and the sharp tip of the needle is achieved.

In FIG. 1E, sealing member 15 includes a self-rupturing mechanism in the form of a collapsible channel, perforation and/or orifice 26 penetrating through sealing member 15, e.g. penetrating through inner surface 15*a* and outer surface 15*b*. According to some embodiments of the present invention, orifice may be a collapsible orifice that allows leakage only under a predetermined pressure, e.g. a pressure substantially higher than the nominal lower inner pressure of the container. In some exemplary embodiments, orifice 26 is uniform in cross section. Alternatively, orifice may include a converging and/or diverging channel.

According to some embodiments of the present invention, fluid is dispensed from fluid container 10 using an inverted injection mechanism where the plug of the container is pierced by a hollow needle and then is retracted along the housing of the container to force the liquid out though the needle. An exemplary inverted injection mechanism may be similar to the mechanism described in U.S. Pat. No. 1,929,247 to Hein. The disclosure of this patent is fully incorporated herein by reference.

Exemplary Chamber Including a Receiving Port

Figure 2:
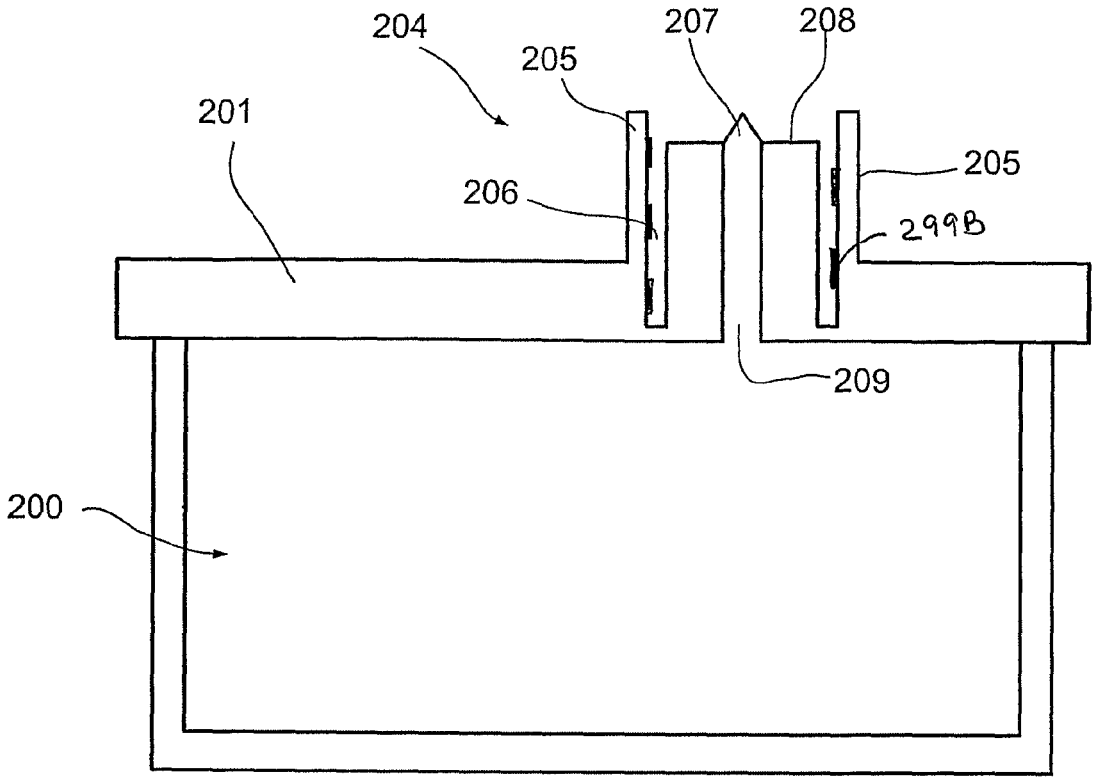
FIG. 2 is a schematic illustration of a chamber with a receiving port for receiving liquid from a sealed fluid container according to some embodiments of the present invention.
Figure 3D:
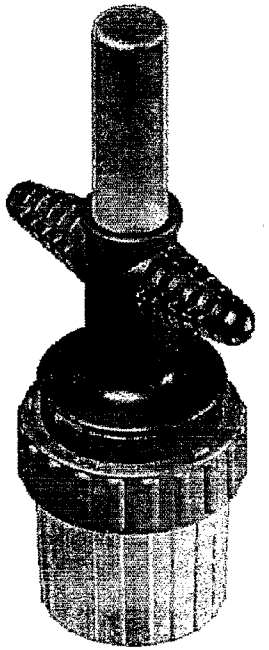
FIGS. 3A, 3B, 3C and 3D are isometric, front, top, and section views of fluid delivery system for dispensing a liquid from a fluid container directly into a mixing chamber prior to the onset of dispensing according to some embodiments of the present invention.
Figure 3C:
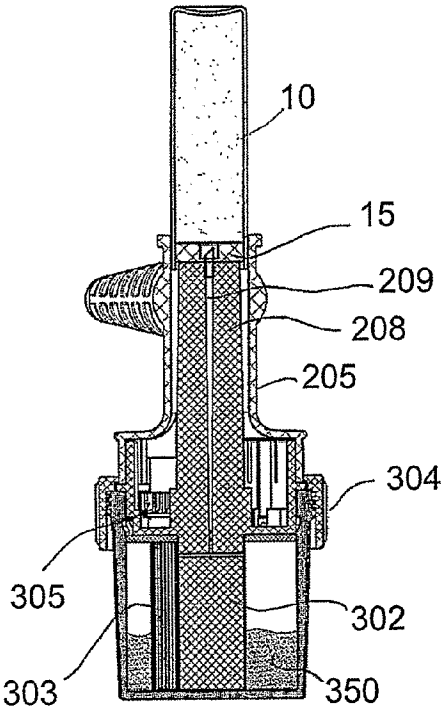
Figure 3A:
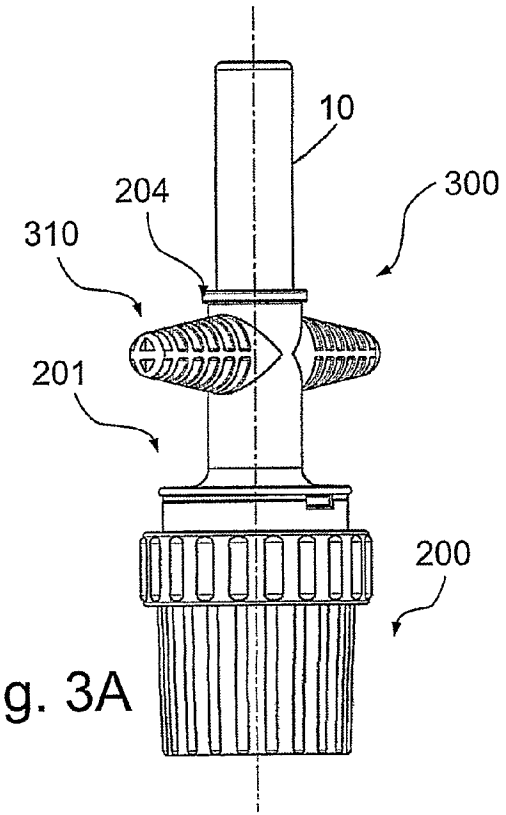
Figure 3B:
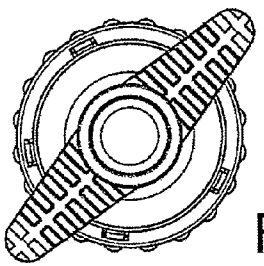
Figure 4D:
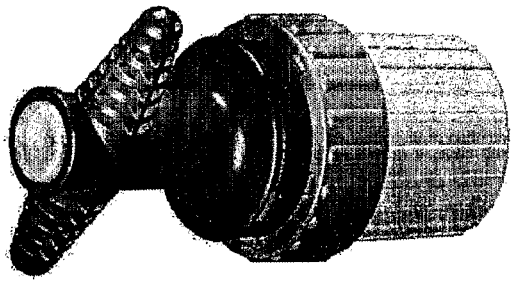
FIGS. 4A, 4B, 4C and 4D are isometric, front, top, and section views of fluid delivery system for dispensing a liquid from a fluid container directly into a mixing chamber after dispensing of the fluid according to some embodiments of the present invention.
Figure 4C:
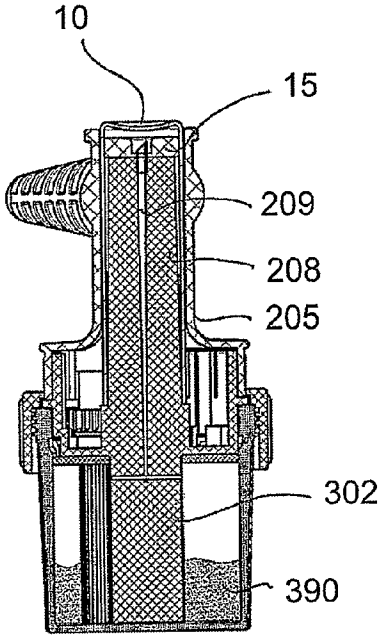
Figure 4A:
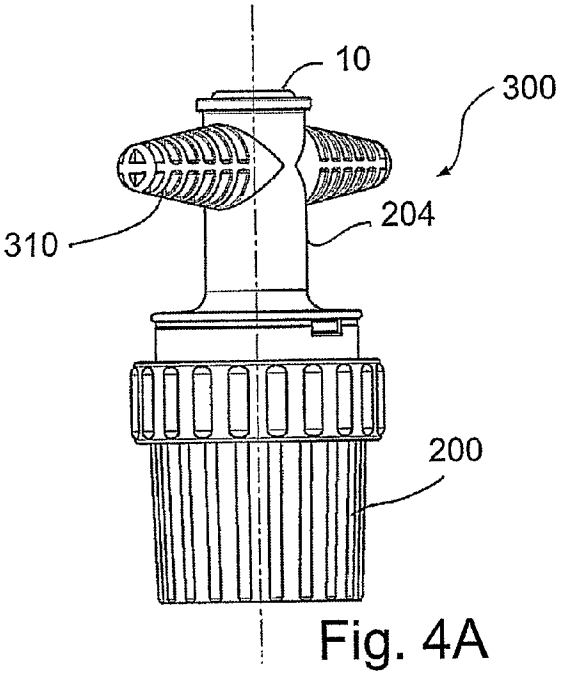
Figure 4B:
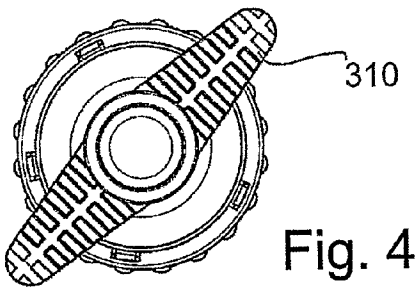

Reference is now made to FIG. 2 showing a schematic illustration of a chamber with a receiving port for receiving fluid from a sealed fluid container according to some embodiments of the present invention. According to embodiments of the present invention, a chamber 200 includes a cover 201 and a receiving port 204. According to some embodiments of the present invention, at least some of the component parts of chamber 200 are resistant to active materials and monomers, e.g. Methylmethacrylate. In some exemplary embodiments, component parts of chamber 200 are fabricated from polyamides, e.g. Nylon and/or polypropylene. Optionally, some component parts of chamber 200 are fabricated from metal, e.g. Stainless Steel.

According to some embodiments of the present invention, receiving port 204 includes a hollow protrusion, an extension and/or wall 205, an inner element 208 within the confines of wall 205 and displaced from the wall, and a gap and/or groove 206 between wall 205 and element 208. According to some embodiments of the present invention, gap 206 is at least wide to permit housing 13, e.g. housing walls, to fit through gap 206. According to embodiments of the present invention, receiving port 204 is capable of telescopically receiving fluid container 10 with in the confines of wall 205 such that the housing of fluid container 10 may fit and slide along wall 204 within gap 206. Typically, wall 205 is tubular having an inner diameter compatible with the outer diameter of fluid container 10 so that fluid container 10 may fit, e.g. snuggly fit, within tubular wall 205. In alternate embodiments of the present invention tubular wall 205 may have an outer diameter compatible with the inner diameter of fluid container 10 so that fluid container 10 may fit over wall 205 and may slide over wall 205. Optionally, wall 205 may include screw threads 299B for receiving the fluid container by threaded motion.

Typically, inner element 208 is tubular in shape, e.g. with a circular cross section, and includes one or more channels 209 directed toward the inside of chamber 200. In some exemplary embodiments, the channel is concentric with inner element 208. According to some embodiments of the present invention channel 209, a hollow tube and/or needle 207 may be positioned within channel 209. For example, a sharp edge of needle 207 may protrude out of chamber 200 so that when fluid container 10 is mounted on receiving port 204, the needle may facilitate rupturing the seal of the fluid container.

According to some embodiments of the present invention, support elements 28 may rigidly support sealing member and/or piston 15 in place while fluid container 10 may be telescopically collapsed through receiving port 204, e.g. while fluid container 10 is made to slide through groove 206. Sliding fluid container 10 through groove 206, while supporting piston 15 in place with support member 208 facilitates increasing the inner pressure of fluid container 10 so that fluid 14 contained within the fluid container will be released.

According to embodiments of the present invention, wall 205, support element 208, and groove 206 may be designed to permit axial sliding of fluid container 10 into gap 206, when inserted into receiving port 204, e.g. sealing member 15 facing the receiving port. In some exemplary embodiments, wall 205, element 208, and/or fluid container 10 may include screw threads so that fluid container 10 may advance into groove 206 with threaded rotation. In an exemplary embodiment of the invention, support element 208 is designed to withhold progress of said piston when the fluid container is pushed towards chamber 22. According to some embodiments of the present invention, support element 208 includes a sharp end 207 that may puncture the plug of the fluid container (e.g. by penetrating a sealing membrane, as described above) so fluids within the vial may flow into passage 29 through said puncture while the vial is pressed into gap 206.

According to some embodiments of the present invention, scale marks and/or quantities may be marked on the fluid container and may correspond to quantities provided by a corresponding powder component of the bone cement. According to some embodiments of the present invention, scale marks and or quantities may be marked on the mixing chamber.

Exemplary Fluid Delivery System

Reference is now made to FIGS. 3A, 3B, 3C and 3D showing isometric, front, top, and section views of an exemplary fluid delivery system for dispensing a liquid from a fluid container directly into a mixing chamber according to some embodiments of the present invention. As shown, mixing apparatus 300 comprises of mixing chamber 200 and cover 201. Typically, cover 201 includes a receiving port 204 and a handle 310. According to embodiments of the present invention, fluid container 10 is positioned within the receiving port so that the sealing member 15 faces the entrance into the receiving port. Chamber 200 is shown to include a component of bone cement 350, e.g. a powder component. According to some embodiments of the present invention the receiving port is concentric with handle 310 and the handle 310 is substantially concentric with the chamber 200. Centering the receiving port through which the fluid container is to be inserted optionally serves to stabilize the system, e.g. mixing chamber together with fluid container.

According to some embodiments of the present invention, mixing chamber 200 may be a mixing chamber for mixing components of bone cement. According to some embodiments of the present invention, mixing chamber 200 may be suitable and/or specifically designed for mixing highly viscous materials in small batches.

According to some exemplary embodiments of the present invention, mixing chamber 200 and cover 201 may be similar to the mixing apparatus described in U.S. patent application Ser. No. 11/428,908 filed on Jul. 6, 2006, the disclosure of which is fully incorporated herein by reference. In some exemplary embodiments, cover 201 incorporates a fastening nut 304 that permits relative rotational movement between cover 201 and not 304, e.g. when handle 310 is manually rotated around a longitudinal axis of receiving port 204. In an exemplary embodiment of the invention, mixing apparatus 300 is a planetary mixer, comprising center mixing arm 302, at least one planetary mixing arm 303 and planetary gear 305. Optionally, planetary gear 305 may be located inside cover 201. Optionally, center mixing arm 302 may be a continuous projection of at least one of the components of cover 201. Typically, mixing arm 305 is rotated as handle 310 is rotated to facilitate the mixing.

According to some embodiments of the present invention, receiving port 204 of cover 201 also includes an extension and/or wall 205, an inner element 208 within the confines of wall 205 and displaced from the wall to form a gap and/or groove 206 as was described in reference to FIG. 2. According to embodiments of the present invention, to initiate operation of the fluid delivery system, the fluid container 10 is telescopically introduced into receiving port 204. According to embodiments of the present invention, prior to dispensing fluid 14 from fluid container 10 into chamber 200, a dry and/or powder component 350 e.g. Polymethylmethacrylate based powder component, is contained in the chamber and fluid container 10 is substantially fully protruding from receiving port 204 as is shown in FIGS. 3A, 3B, 3C and 3D. Prior to the mixing operation of mixing chamber 201, the fluid container 10 is pushed into the receiving port to facilitate puncturing of seal 15 and to push out the fluid from the container toward the mixing chamber through channel 209 as is described herein. Subsequently handle 310 is rotated to facilitate the mixing. One or more channels may be used to direct the liquid into the chamber. For example a plurality of channels may be used to, for example, evenly distribute the liquid throughout the volume of the chamber.

Reference is now made to FIGS. 4A, 4B, 4C and 4D showing isometric, front, top, and section views of fluid delivery system after dispensing of the fluid according to some embodiments of the present invention. Fluid container 10 is shown to be telescopically collapsed into receiving port 204 such that all and/or substantially all the fluid has been dispensed into chamber 200.

During operation a user slides the fluid container through receiving port 204 and uses handles 310 to mix the bone cement 390 contained within the mixing chamber. In some exemplary embodiments, advancing the fluid container into receiving port 204 is by inward threading of the fluid container. In some embodiments of the present invention, all the fluid is dispensed prior to mixing. In other exemplary embodiments, a user may only partially dispense before mixing and or dispense and mix intermittently as required. Optionally, the amount of delivered fluid may be monitored by scales marked on the fluid container and/or on the receiving port. In one exemplary embodiment of the invention, fluid container 10 is transparent relatively to the fluid and/or to piston 15.

Preferably, the inner volume of mixing chamber 32 is large enough to contain all mixing arms, powder component 40 and a desired quantity of liquid component to be injected from vial and/or fluid container 10. Optionally, said desired quantity is introduced into mixing chamber 32 while compressing entrapped air; said introduction is applicative under normal manual forces/moment.

According to some embodiments of the present invention, mixing apparatus 300 may include a holder to prevent undesired backward movement of fluid container 10 through the receiving port. For example, the holder may include threaded portions and/or holding snaps.

According to some embodiments of the present invention, fluid container 10 and mixing apparatus 300 maintain a sealed environment throughout the injection and/or dispensing procedure so that materials, e.g. gaseous, liquid and/or solid materials, cannot leak into and or infiltrate from the surroundings.

According to some embodiments of the present invention, mixing apparatus 300 may include an opening and/or a connection to vacuum source. According to some embodiments of the present invention, mixing apparatus 300 may include a pressure relief valve, which may be operated before or after the dispensing and/or injection procedure.

Optionally, the delivery mechanism is detachably coupled to a mixer element (e.g. a mixer cap/cover, a rotating/static handle, a mixer body, etc.). Alternatively, said delivery mechanism is an integral part of said mixer element. Alternatively, the fluid delivery mechanism and/or the receiving port are separated form the handle and/or mixer element.

The present invention may be equally applicable to all mixing apparatuses, especially though not limited, to bone filler materials mixers. Optionally, said mixing apparatuses are especially designed for mixing highly viscous materials in small batches. In some exemplary embodiment of the invention, "highly viscous" indicates a viscosity of 500, 700 or 900 Pascal/second or lesser or greater or intermediate viscosities. Optionally, this viscosity is achieved within 30, 60, or 90 seconds of onset of mixing. However, under some circumstances the mixing may take a longer time. A small batch may be 100, 50, 25, 15 or 5 ml or lesser or intermediate volumes at the completion of mixing.

In an exemplary embodiment of the invention, the highly viscous material is a bone filler or "bone cement". Optionally, the bone cement includes a polymeric material, for example polymethylmethacrylate (PMMA). Optionally, the bone cement is one of several types described in one or more of U.S. patent application Ser. Nos. 11/194,411; 11/360,251; and 11/461,072 and U.S. provisional application 60/825,609. The disclosures of all of these applications are fully incorporated herein by reference.

In typical vertebrae treatment procedures, a volume of approximately 5 ml is injected in a single vertebra. It is common to prepare a batch of approximately 8 ml of cement if a single vertebra is to be injected, approximately 15 ml of cement if two vertebrae are to be injected and progressively larger volumes if three or more vertebrae are to be injected. Combination of powdered polymer component and liquid monomer component leads to a reduction in total mixture volume as the polymer is wetted by the monomer. For example, 40 to 50 ml of polymer powder may be mixed with 7 to 9 ml of monomer liquid to produce 18 ml of polymerized cement. In an exemplary embodiment of the invention, a volume of well 252 is selected to accommodate the large initial column of monomer powder, even when a significantly smaller batch of cement is being prepared.

According to various exemplary embodiments of the invention, an inner volume of the mixing chamber 200 may be between 5-150 ml, e.g. 50 or 60. In an exemplary embodiment of the invention, the mixing chamber volume is between 50 to 60 ml, optionally about 66 ml, and is adapted to contain between 10 to 20 ml of mixture. In an exemplary embodiment of the invention, a portion of the inner volume of chamber 32 is occupied by mixing arms 32*a* and 32*b*. According to some embodiments of the present invention, the height of the chamber is between 20-100 mm, e.g. 40.

The present invention has been described using detailed descriptions of embodiments thereof that are provided by way of example and are not intended to necessarily limit the scope of the invention. In particular, numerical values may be higher or lower than ranges of numbers set forth above and still be within the scope of the invention. The described embodiments comprise different features, not all of which are required in all embodiments of the invention. Some embodiments of the invention utilize only some of the features or possible combinations of the features. Alternatively or additionally, portions of the invention described/depicted as a single unit may reside in two or more separate physical entities which act in concert to perform the described/depicted function. Alternatively or additionally, portions of the invention described/depicted as two or more separate physical entities may be integrated into a single physical entity to perform the described/depicted function. Variations of embodiments of the present invention that are described and embodiments of the present invention comprising different combinations of features noted in the described embodiments can be combined in all possible combinations including, but not limited to use of features described in the context of one embodiment in the context of any other embodiment. The scope of the invention is limited only by the following claims.

In the description and claims of the present application, each of the verbs "comprise", "include" and "have" as well as any conjugates thereof, are used to indicate that the object or objects of the verb are not necessarily a complete listing of members, components, elements or parts of the subject or subjects of the verb.

The invention claimed is:

1. A fluid delivery system for dispensing a liquid from a sealed container directly into a closed chamber comprising:

a container containing a liquid component of bone cement and plugged with a plug;

a chamber comprising at least one mixing arm and a receiving port for receiving the container, wherein the receiving port includes a hollow protrusion for telescopically receiving the container, and the receiving port is configured so that the liquid component is transferred into the chamber in direct response to manual insertion of the container through the receiving port using an open loop system; and a handle configured to rotate to advance the at least one mixing arm within the chamber to stir the bone cement.

2. The system according to claim 1 wherein the plug is configured for retracting into the container during the dispensing.

3. The system according to claim 1 wherein the plug is configured for retracting through the container in response to manually exerted pressure on the container during insertion of the container through the receiving port.

4. The system according to claim 1 wherein the plug includes a defined area configured for puncturing, and the defined area includes at least one blind hole.

5. The system according to claim 1 wherein the receiving port includes a support element configured to support the plug at a defined height.

6. The system according to claim 1, wherein the at least one mixing arm is configured for mixing bone cement having a viscosity above 200 Pascal/second.

7. The system of claim 1, wherein the receiving port is formed in a cover on the chamber.

8. The system of claim 5, wherein the support element is disposed within the hollow protrusion and forms a gap therebetween.

9. The system of claim 8, wherein the container is axially slidable within the gap between an outer surface of the support element and an inner surface of the hollow protrusion.

10. The system of claim 5, wherein the support element and the hollow protrusion are substantially tubular shaped.

11. The system of claim 5, wherein the support element includes at least one channel formed therein for transferring liquid from the container to the chamber.

12. The system of claim 11, wherein the at least one channel is substantially concentric with the hollow protrusion.

13. The system of claim 11, wherein the at least one channel includes a hollow needle.

14. The system of claim 1, wherein the handle is configured to rotate around a longitudinal axis of the receiving port to advance the at least one mixing arm within the chamber.

15. The system of claim 1, wherein the receiving port and the handle are substantially concentric with the chamber.

16. The system of claim 1, wherein the liquid component comprises a monomer.

17. The system of claim 1, wherein the chamber contains a powder component of bone cement.

18. The system of claim 17, wherein the powder component comprises a polymer.

19. The system of claim 1, wherein the container is configured to telescopically collapse into the receiving port to dispense substantially all of the liquid component into the chamber.

20. The system of claim 1, wherein the plug is configured to slide along an entire length of the container.

21. The system of claim 1, wherein the receiving port includes screw threads configured for advancing the container through the receiving port by threaded rotation.

22. The system of claim 21, wherein the container includes screw threads configured to mate with the threads formed on the receiving port.

23. The system of claim 1, wherein the at least one mixing arm comprises a central mixing arm and at least one planetary mixing arm.

24. The system of claim 1, wherein the handle and the receiving port are formed on a cover of the chamber.

25. The system of claim 1, wherein the container is substantially rigid.

26. The system of claim 1, wherein an entire length of the container is configured to telescopically collapse into the receiving port.

27. A fluid delivery system for dispensing a liquid from a sealed container directly into a closed chamber comprising:

a container containing a liquid component of bone cement and plugged with a plug, the plug being configured to retract into the container; and a chamber comprising a receiving port for receiving the container, wherein the receiving port includes a hollow protrusion for telescopically receiving the container; and a holder configured to prevent the container from withdrawing away from the chamber when the container is being telescopically inserted through the receiving port;

wherein manually advancing the container through the receiving port causes the plug to retract into the container and dispenses the liquid component from the container into the chamber.

28. The system of claim 27, wherein the plug is configured to retract along an entire length of the container when the container is manually inserted through the receiving port.

29. The system of claim 27, wherein the receiving port includes screw threads configured for inserting the container through the receiving port by threaded rotation.

30. The system of claim 29, wherein the container includes screw threads configured to mate with the threads formed on the receiving port.

31. The system of claim 1, wherein the chamber includes a plurality of mixing arms configured to rotate to stir bone cement.

32. The system of claim 27, wherein, during dispensing of the liquid from the container and into the chamber, the holder is configured to hold the container in a fixed axial position relative to the chamber when the manual force is not applied to the container.

33. The system of claim 32, wherein the container includes scale markings so that a user can visually monitor a volume of liquid in the container.

* * * * *